US009128427B2

(12) United States Patent
Nawa et al.

(10) Patent No.: US 9,128,427 B2
(45) Date of Patent: Sep. 8, 2015

(54) IMAGE HEATING APPARATUS

(71) Applicant: CANON KABUSHIKI KAISHA, Tokyo (JP)

(72) Inventors: Masahiro Nawa, Kumamoto (JP); Keisuke Mogi, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/946,336

(22) Filed: Jul. 19, 2013

(65) Prior Publication Data

US 2014/0037308 A1 Feb. 6, 2014

(30) Foreign Application Priority Data

Jul. 31, 2012 (JP) ..... 2012-169520
Jun. 13, 2013 (JP) ..... 2013-124633

(51) Int. Cl.
*G03G 15/00* (2006.01)
*G03G 15/20* (2006.01)

(52) U.S. Cl.
CPC ..... *G03G 15/2017* (2013.01); *G03G 15/2042* (2013.01); *G03G 15/2053* (2013.01)

(58) Field of Classification Search
USPC ..... 399/45, 69
See application file for complete search history.

(56) References Cited

U.S. PATENT DOCUMENTS 6,810,230 B2 * 10/2004 Imai et al. ..... 399/328
7,045,749 B2 * 5/2006 Kinouchi et al. ..... 219/619
7,099,616 B2 8/2006 Kato et al.
7,194,234 B2 * 3/2007 Katakabe et al. ..... 399/330
7,197,270 B2 3/2007 Kato et al.
8,554,097 B2 10/2013 Hara et al.
2003/0077093 A1 4/2003 Sekiguchi
2004/0169036 A1 9/2004 Katakabe et al.
2004/0253027 A1 12/2004 Kato et al.
2004/0253887 A1 12/2004 Katakabe et al.

(Continued)

FOREIGN PATENT DOCUMENTS

CN 1550122 A 11/2004
CN 1573607 A 2/2005
JP 2008-014966 A 1/2003
JP 2004-265669 A 9/2009

OTHER PUBLICATIONS

U.S. Appl. No. 13/948,281, filed Jul. 23, 2013, Masahiro Nawa.

(Continued)

*Primary Examiner* — Clayton E Laballe
*Assistant Examiner* — Warren K Fenwick
(74) *Attorney, Agent, or Firm* — Fitzpatrick, Cella, Harper & Scinto

(57) ABSTRACT

An image heating apparatus includes: a rotatable heating member for heating a toner image formed on a recording material by using a toner containing a parting agent; an exciting coil for causing the rotatable heating member to generate heat by electromagnetic induction heating; a magnetic flux suppressing member for suppressing a part of magnetic flux acting from the exciting coil onto the rotatable heating member; a moving mechanism for moving the magnetic flux suppressing member depending on a width size of the recording material; a motor for operating the moving mechanism; and an executing portion capable of selectively executing an operation in a first mode in which a first current is supplied to the motor and an operation in a second mode in which a second current larger than the first current is supplied to the motor.

19 Claims, 11 Drawing Sheets

(56) References Cited

U.S. PATENT DOCUMENTS

| | | | | |
|---|---|---|---|---|
| 2006/0204292 | A1 | 9/2006 | Kato et al. | |
| 2010/0296828 | A1* | 11/2010 | Hara et al. | 399/69 |
| 2012/0107002 | A1* | 5/2012 | Nakayama et al. | 399/69 |
| 2012/0328338 | A1* | 12/2012 | Nawa et al. | 399/328 |
| 2012/0328342 | A1 | 12/2012 | Takematsu et al. | |
| 2013/0034363 | A1* | 2/2013 | Hara | 399/69 |
| 2013/0094887 | A1 | 4/2013 | Nawa et al. | |
| 2013/0279931 | A1* | 10/2013 | Kakehi | 399/66 |

OTHER PUBLICATIONS

U.S. Appl. No. 13/973,336, filed Aug. 22, 2013, Keisuke Mogi.
U.S. Appl. No. 14/013,419, filed Aug. 29, 2013, Keisuke Mogi.
U.S. Appl. No. 14/013,430, filed Aug. 29, 2013, Keisuke Mogi.
U.S. Appl. No. 14/013,594, filed Aug. 29, 2013, Keisuke Mogi.
Chinese Office Action issued in counterpart Chinese Patent Application No. 201310328854.8, Jun. 2, 2015.

* cited by examiner

IMAGE HEATING APPARATUS

FIELD OF THE INVENTION AND RELATED ART

The present invention relates to an image heating apparatus for heating a toner image formed on a recording material. This image heating apparatus is usable in image forming apparatuses such as a copying machine, a printer, a facsimile machine and a multi-function machine having a plurality of functions of these machines, for effecting image formation by using, e.g., an electrophotographic type, electrostatic recording type, magnetic recording type and the like.

In the following, as the image heating apparatus, a fixing device (apparatus) will be described as an example. In the fixing device for fixing the toner image formed on the recording material, a type in which heat is generated by Joule heat by generating an eddy current in a fixing roller by a magnetic field generated by an exciting coil as a means for heating the fixing roller (rotatable heating member) has been proposed. In this type of device, a heat generating source can be placed very near to a toner, and therefore compared with a conventional type of fixing device using a halogen lamp, the above-proposed type of fixing device can shorten the time required until the temperature of the fixing roller during actuation of the fixing device reaches a fixing temperature. Further, the above-proposed type of fixing device also uses a short heat-conduction path from the heat generating source to the toner, and therefore heat efficiency is high.

However, in the fixing device as described above, when many recording papers narrower in width than the maximum width recording paper usable in the fixing device (hereinafter referred to as small-sized paper) are continuously subjected to fixing, a so-called non-sheet-passing-portion temperature rise is generated. That is, in a region (sheet passing portion) where a fixing roller surface contacts the recording paper, heat is taken by the recording paper, and on the other hand, in a region (non-sheet-passing portion) where the fixing roller surface does not contact the recording paper, heat is not taken by the recording paper, so that a large temperature difference is generated in some cases. This is the non-sheet-passing-portion temperature rise.

When such a non-sheet-passing-portion temperature rise is generated, it leads to thermal deterioration, and therefore countermeasures may preferably be taken.

For that reason, in an apparatus described in Japanese Laid-Open Patent Application (JP-A) 2004-265669, a magnetic flux suppressing member having a magnetic shielding effect is used. Specifically, in the case where the small-sized paper is subjected to fixing, the magnetic flux suppressing member is moved to a non-sheet-passing-portion-temperature-rise suppressing position by driving a motor to operate a moving mechanism.

However, a wax as a parting agent is contained in the toner, and therefore the wax volatized during the fixing is deposited on the moving mechanism for the magnetic flux suppressing member. In the case where the wax is cooled and solidified, an improper operation can be caused, and therefore it has been required that countermeasures against this problem are taken.

SUMMARY OF THE INVENTION

A principal object of the present invention is to provide an image heating apparatus capable of properly moving a magnetic flux suppressing member.

According to an aspect of the present invention, there is provided an image heating apparatus comprising: a rotatable heating member for heating a toner image formed on a recording material by using a toner containing a parting agent; an exciting coil for causing the rotatable heating member to generate heat by electromagnetic induction heating; a magnetic flux suppressing member for suppressing a part of magnetic flux acting from the exciting coil onto the rotatable heating member; a moving mechanism for moving the magnetic flux suppressing member depending on a width size of the recording material; a motor for operating the moving mechanism; and an executing portion capable of selectively executing an operation in a first mode in which a first current is supplied to the motor and an operation in a second mode in which a second current larger than the first current is supplied to the motor.

According to another aspect of the present invention, there is provided an image heating apparatus comprising: a rotatable heating member for heating a toner image formed on a recording material by using a toner containing a parting agent; an exciting coil for causing the rotatable heating member to generate heat by electromagnetic induction heating; a magnetic flux suppressing member for suppressing a part of magnetic flux acting from the exciting coil onto the rotatable heating member; a moving mechanism for moving the magnetic flux suppressing member depending on a width size of the recording material; a motor for driving the moving mechanism; and an executing portion capable of selectively executing an operation in a first mode in which the motor is operated at a first speed and an operation in a second mode in which the motor is operated at a second speed slower than the first speed.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a) and (b) of FIG. 1 are exploded views of constituent members of a fixing device (image heating apparatus) in Embodiment 1, wherein (a) shows a state in which each of left and right magnetic flux suppressing members is located in an initial position, and (b) shows a state in which each of the left and right magnetic flux suppressing members is moved to an adjusting position corresponding to a position of a minimum size width recording material during sheet passing.

DESCRIPTION OF THE PREFERRED EMBODIMENTS

Hereinbelow, embodiments of the present invention will be described, but although the embodiments are an example of best mode in the present invention, the present invention is not limited to these embodiments.

Embodiment 1

Image Forming Apparatus

Figure 2:
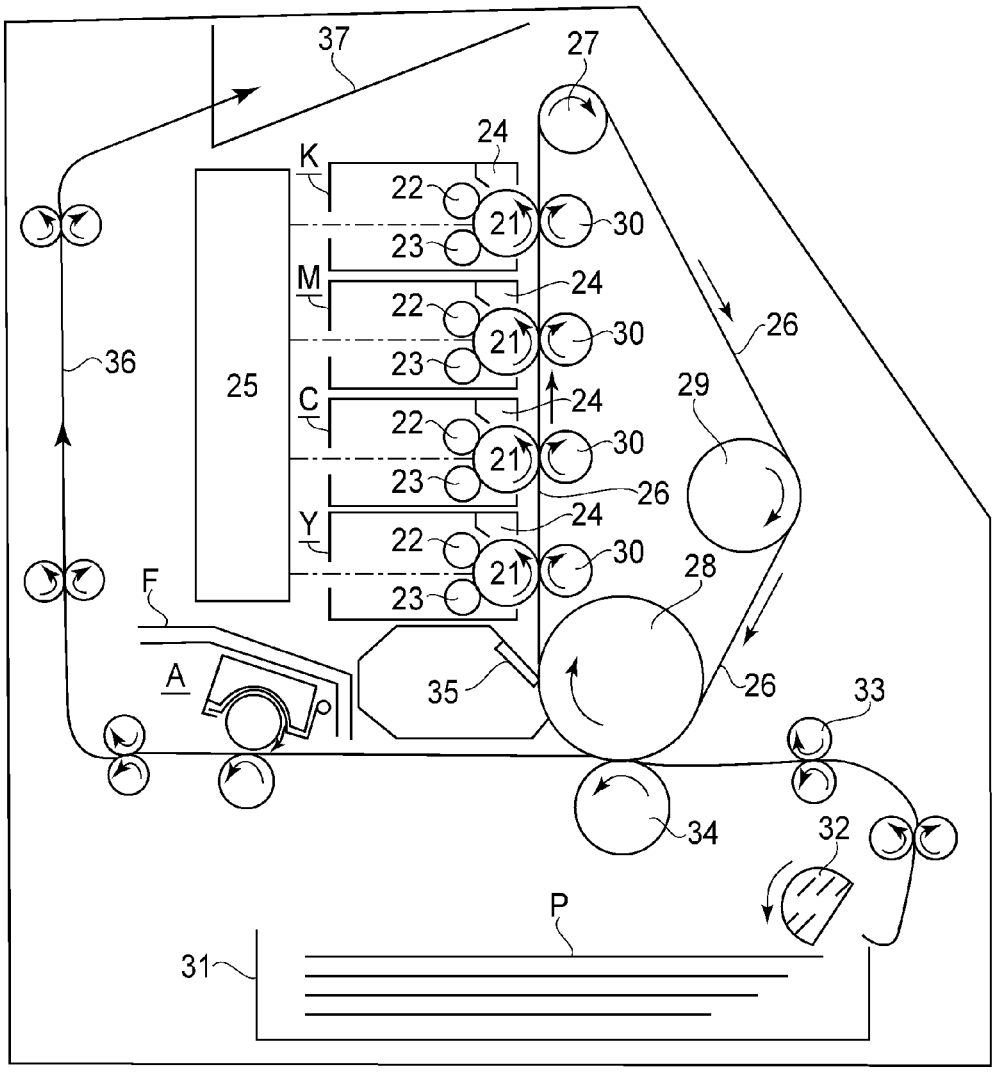
FIG. 2 is a sectional view of an image forming apparatus in Embodiment 1.

FIG. 2 is a structural view of an embodiment of an image forming apparatus in which an image heating apparatus according to the present invention is mounted as a fixing device A. This image forming apparatus is a color image forming apparatus using an electrophotographic type.

Y, C, M and K represent four image forming portions for forming color toner images of yellow (Y), cyan (C), magenta (M) and black (K), respectively, and are arranged in this order from a lower portion to an upper portion. Each of the image forming portions Y, C, M, and K includes an electrophotographic photosensitive drum 21, a charging device 22, a developing device 23, a cleaning device 24, and the like.

In the developing device 23 of the image forming portions Y, C, M and K, toners of Y, C, M and K are accommodated. In these toners, a wax as a parting agent is contained so that the toners are hard to be deposited on a belt (rotatable heating member) 1 described later.

Each drum 21 is rotationally driven in the counterclockwise direction of an arrow at a predetermined peripheral speed. An optical system 25 for forming an electrostatic latent image by subjecting each of the drums 21 to exposure to light is provided correspondingly to the image forming portions Y, C, M and K for the above-described four colors. As the optical system, 25, a laser scanning exposure optical system is used.

At each of the image forming portions, Y, C, M and K, the drum 21 electrically charged uniformly by the charging device 22 is subjected to scanning exposure on the basis of image data by the optical system 25, so that an electrostatic latent image corresponding to a scanning exposure image pattern is formed on the drum surface.

The resultant electrostatic latent images are developed into the toner images by the developing devices 23. That is, a yellow (Y) toner image is formed on the drum 21 for the yellow image forming portion Y and a cyan (C) toner image is formed on the drum 21 for the cyan image forming portion C. Further, a magenta (M) toner image is formed on the drum 21 for the magenta image forming portion M and a black (K) toner image is formed on the drum 21 for the image forming portion K.

The above-described color toner images formed on the drums 21 for the respective image forming portions Y, C, M and K are successively primary-transferred superposedly onto an intermediary transfer member 26, rotated in synchronism with and at the substantially same speed as rotation of the respective drums 21, in a predetermined alignment state. As a result, unfixed full-color toner images are synthetically formed on the intermediary transfer member 26. The belt 26 is wound and stretched around three rollers consisting of a driving roller 27, a secondary transfer opposite roller 28, and a tension roller 29. Further, the belt 26 is driven by the driving roller 27 in the clockwise direction of an arrow at the substantially same peripheral speed as that of the drum 21 to be circulated and moved.

As a primary transfer means for transferring the toner image from the drum 21 for each of the image forming portions Y, C, M and K onto the belt 26, a primary transfer roller 30 is used. To the primary transfer roller 30, a primary transfer bias of a polarity opposite to that of the toner is applied from an unshown bias power source. As a result, the toner image is primary-transferred from the drum 21 for each of the image forming portions Y, C, M and K onto the belt 26. After the primary-transfer from the drum 21 onto the belt 26 at each of the image forming portions Y, C, M and K, toner remaining on the photosensitive drum 21 as transfer residual toner is removed by the cleaning device 24.

The above-described steps are performed with respect to the respective colors of Y, C, M and K in synchronism with the rotation of the belt 26 to successively form superposedly the primary-transferred toner images for the respective colors on the belt 26. Incidentally, during image formation for only a single color (in a single color mode), the above-described steps are performed for only an objective color.

A recording paper (recording material) P in a recording paper cassette 31 is separated and fed one by one by a feeding roller 32. The fed recording paper P is conveyed, with predetermined timing by registration rollers 33, to a secondary transfer nip which is a press-contact portion between a secondary transfer roller 34 and a belt 26 portion extended and wound around the secondary transfer opposite roller 28.

The primary-transferred synthetic toner images formed on the belt 26 are simultaneously transferred onto the recording paper P by a bias, of a polarity opposite to that of the toner, applied from an unshown bias power source to the secondary transfer roller 34. After the secondary transfer, secondary transfer residual toner remaining on the belt 26 is removed by an intermediary transfer belt cleaning device 35.

The toner images secondary-transferred onto the recording paper P are heat-fixed (fusing and color mixing fixing) on the recording paper P by a fixing device A as the image heating apparatus, so that the recording paper P is sent, as a full-color print, to a sheet discharge tray 37 through a sheet discharge path 36.

<Fixing Device A>

In the following description, with respect to the fixing device A or members constituting the fixing device A, a longitudinal direction or a widthwise direction refers to a direction parallel to a direction perpendicular to a recording paper conveyance direction a (FIG. 5) in a plane of a recording paper conveyance path of the fixing device A. Further, a short direction refers to a direction parallel to the recording material conveyance direction a. With respect to the fixing device A, a front surface refers to a surface as seen from a recording paper entrance side with respect to the recording paper conveyance direction, and a rear surface is a surface (a recording paper exit side) opposite from the front surface. The left (side) and the right (side) refer to left (side) and right (side) as seen from the front surface side of the fixing device A. An upstream side and a downstream side refer to an upstream side and a downstream side with respect to the recording paper conveyance direction a. Up and down are up and down with respect to a direction of the gravitation.

Figure 3:
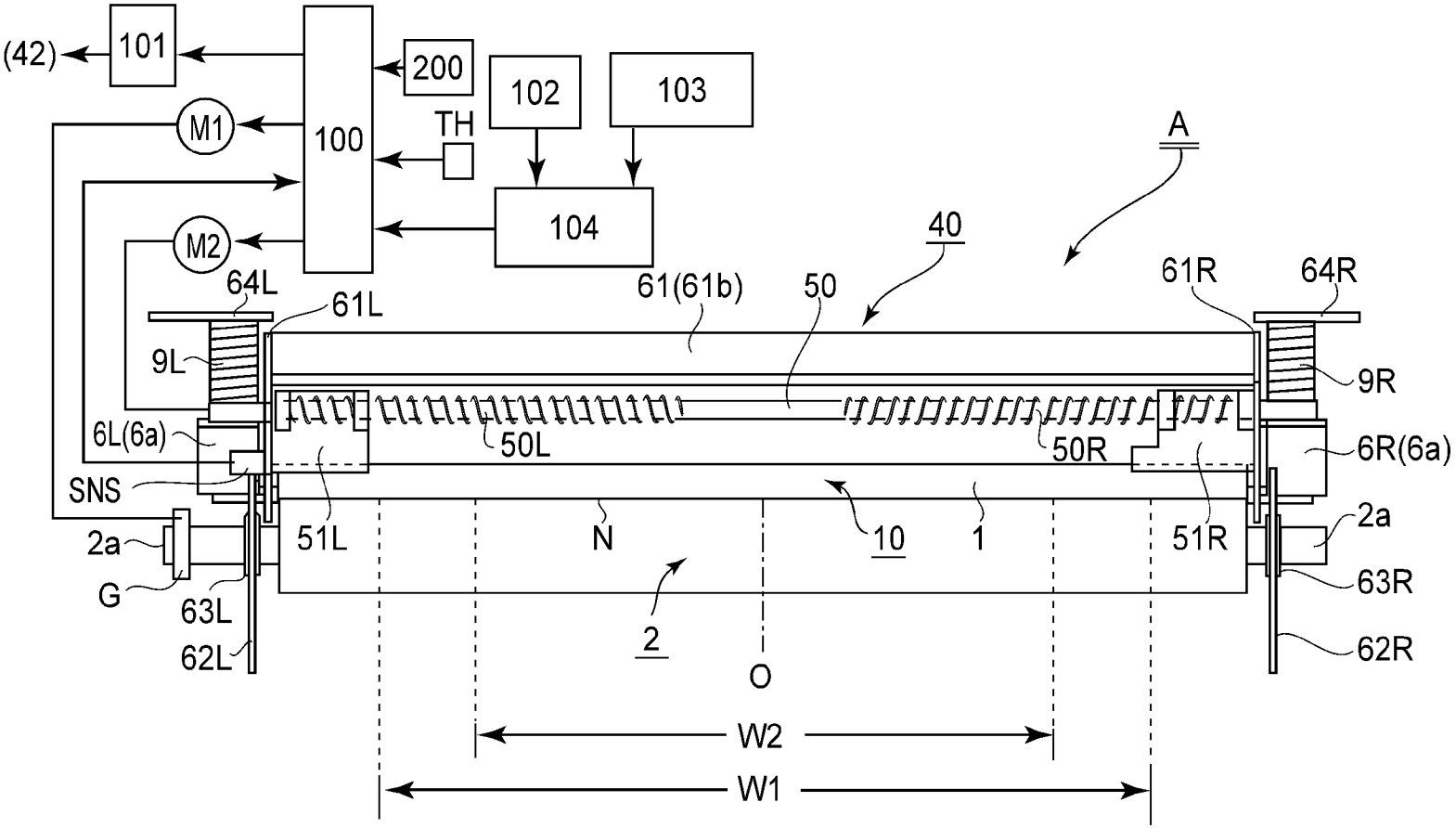
FIG. 3 is a schematic front view of a principal part of the fixing device and is a block diagram of a control system in Embodiment 1.
Figure 4:
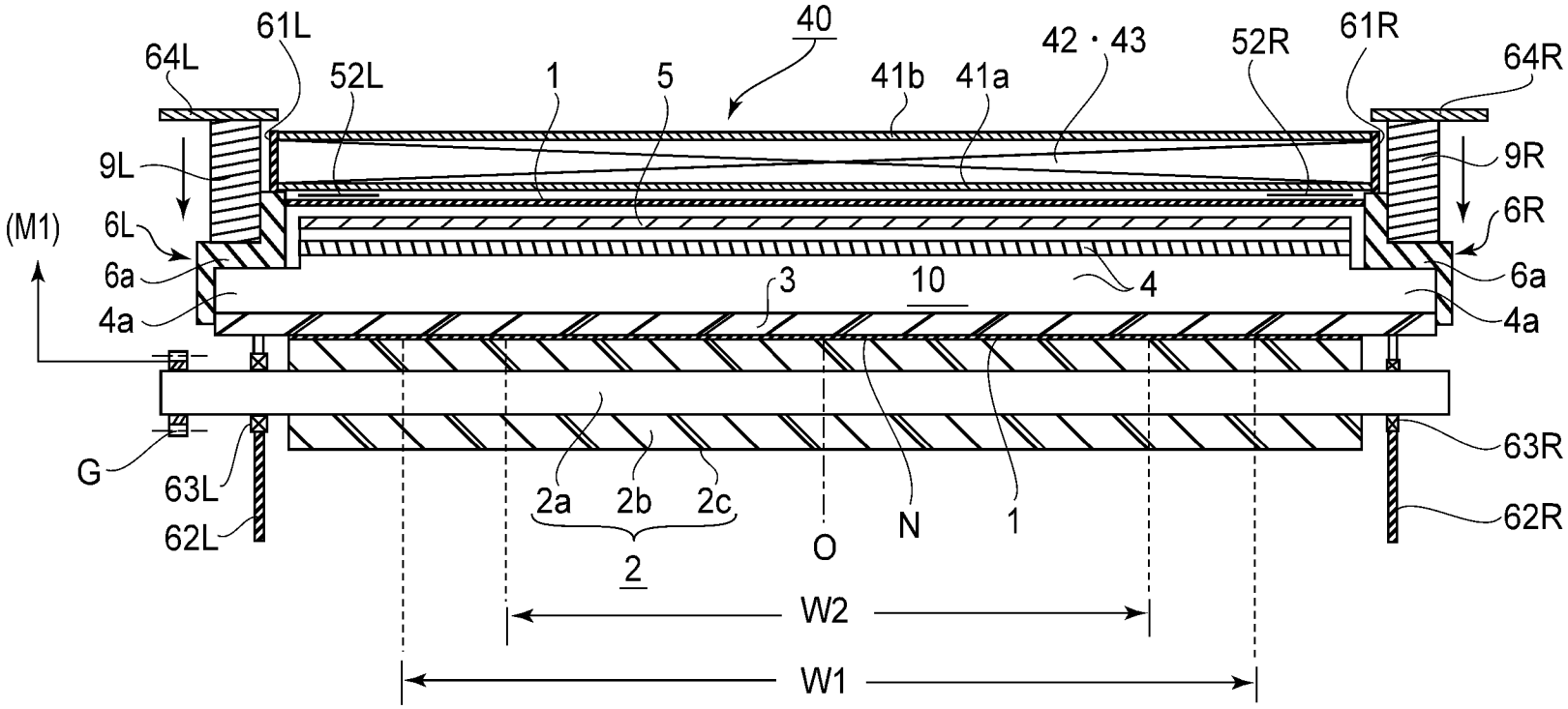
FIG. 4 is a schematic longitudinal front view of the principal part of the fixing device.

The fixing device A in this embodiment is an image heating apparatus of an external heating type and of an electromagnetic induction heating type. FIG. 3 is a schematic front view of a principal part of the fixing device A and is a block diagram of a control system. FIG. 4 is a schematic longitudinal front view of the principal part of the fixing device A. FIG.

Figure 6:
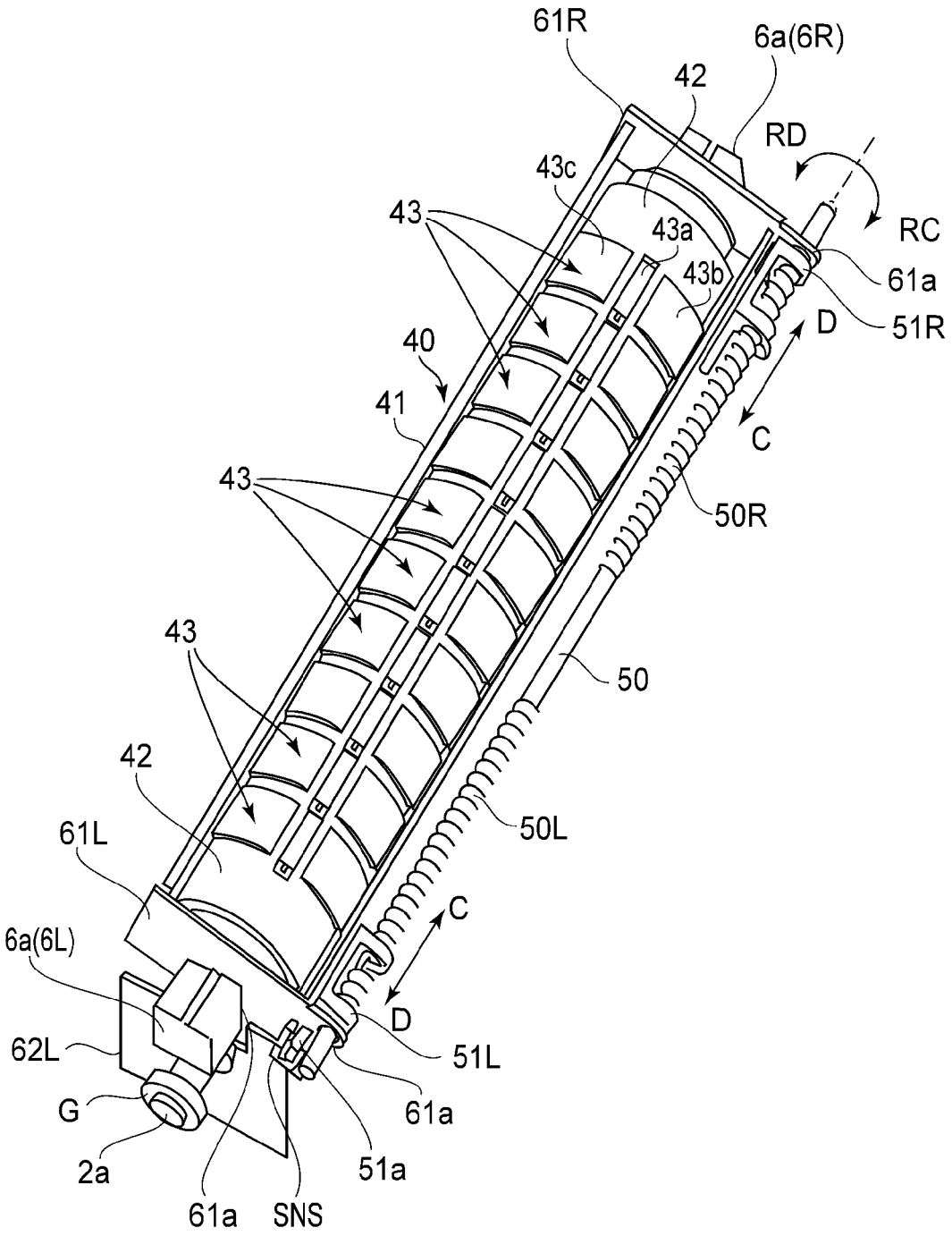
FIG. 6 is a schematic perspective view of the principal part of the fixing device in a state in which an inner portion of a coil unit is shown.

5 is an enlarged schematic cross-sectional view of the principal part of the fixing device A. FIG. 6 is a schematic perspective view of the principal part of the fixing device A in a state in which an inner portion of a coil unit is shown.

This fixing device D roughly includes the following members and means.

a: A heating assembly 10 including a flexible endless belt (hereinafter referred to as a fixing belt or a belt) 1 as a rotatable heating member (image heating member) contactable to an image carrying surface of the recording paper P.

b: An elastic pressing roller 2 as a back-up member (opposing member, pressing member, rotatable pressing member) opposing the belt 1 of the heating assembly 10.

c: A pressing urging member (pressing means) 9 (9L, 9R) for forming a fixing nip (nip) N by press-contacting the belt 1 and the pressing 2 with each other.

d: A coil unit (induction heating device) 40 as a magnetic flux generating means for heating the belt 1.

e: A magnetic flux suppressing member (magnetic flux shielding member, magnetic flux adjusting member) 52 (52L, 52R) and a moving mechanism (driving means) M2, 50, 51 (51L, 51R) for moving the magnetic flux suppressing member.

(1) Heating Assembly 10

The heating assembly 10 includes the rotatable heating member 1 containing a metal layer (magnetic member, electroconductive member) which generates heat by electromagnetic induction when magnetic flux (magnetic field) generated from the coil unit 40 as the magnetic flux generating means described later. In this embodiment, this rotatable heating member 1 is a flexible endless (cylindrical) belt member (endless belt). Further, the rotatable heating member 1 includes a metal-made stay 4 having a downward U-shape in cross section. In a lower side of this stay 4, a pressing pad (nip pad) 3 as a pressure-imparting member is mounted along a longitudinal direction of the stay 4.

The pad 3 is a member for forming the fixing nip N by causing a predetermined pressing (urging) force to act between the belt 1 and the pressing roller 2 and is formed of a heat-resistant resin. The stay 4 is required to have rigidity (stiffness) for applying the pressure to the nip N, and is formed of iron in this embodiment. In an upper side (coil unit 40 side) of the stay 4, an inside magnetic core (magnetic shielding member, magnetic shielding core) 5, having a substantially arcuate shape in cross section, for concentrating the magnetic flux at the belt 1 in order to efficiently induction-heat the belt 1 is provided along the longitudinal direction of the stay 4. This core 5 also prevents a temperature rise due to the induction heating of the metal-made stay 4.

At each of left and right end portions of the stay 4, an extended arm portion 4*a* is provided. The extended arm portions 4*a* project outward from the left and right end portions of the belt 1, respectively. With the left and right arm portions 4*a*, left and right symmetrical flange members 6L and 6R are engaged, respectively. The belt 1 is externally engaged loosely with a composite member of the above-described pad 3, stay 4 and core 5. The left and right flange members 6L and 6R are regulating (limiting) members for regulating (limiting) movement of the belt 1 in the longitudinal direction and the shape of the belt 1 with respect to a circumferential direction.

In the belt 1, as described later, a base layer 1*a* (FIG. 7) is constituted by metal which generates heat by electromagnetic induction heating. For that reason, as described later, as a means for regulating (limiting) lateral movement of the rotating belt 1 in a widthwise direction, the flange members 6L and 6R only for simply receiving end surfaces of the belt 1 may only be required to be provided, so that the constitution of the fixing device A can be simplified.

At a longitudinal central portion of the stay 4, a temperature sensor TH such as a thermistor as a temperature detecting means (temperature detecting element) for detecting a temperature of the belt 1 is provided via an elastic supporting member 7. The sensor TH is elastically contacted to an inner surface of the belt 1 by a member 7. As a result, even when positional fluctuation such as waving of the rotated belt 1 at a sensor contact surface is caused, the sensor TH follows this positional fluctuation, so that a good contact state is maintained.

The above-described belt assembly 10 is provided by engaging pressure-receiving portions 6*a* of the left and right flange members 6L and 6R, between left and right fixed upper side plates 61L and 61R of a fixing device chassis, with vertical guide slit portions 61*a* formed in the side plates 61L and 61R, respectively. Incidentally, a general structure of the chassis was omitted from the figures. Accordingly, the assembly 10 has a degree of freedom such that the assembly 10 is movable in a vertical (up-down) direction along the slit portions 61*a* between the left and right side plates 61L and 61R.

Figure 7:
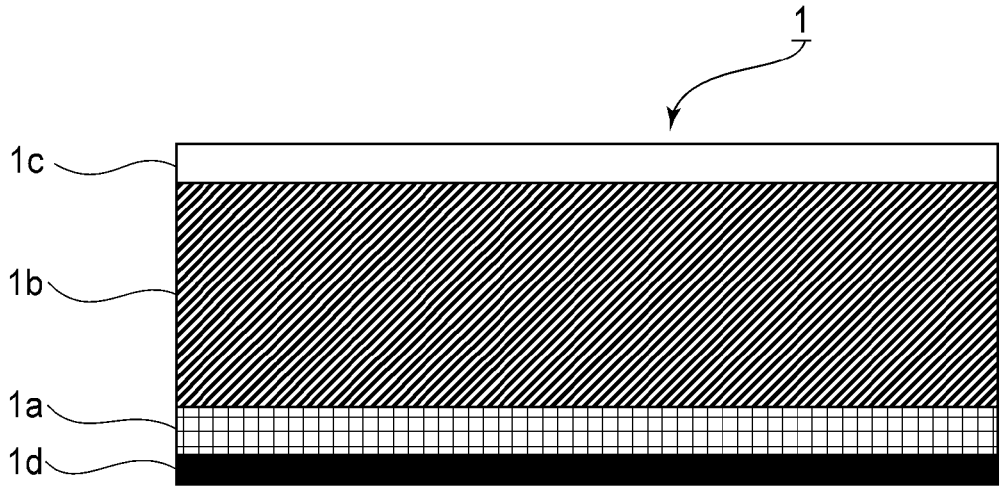
FIG. 7 is a schematic sectional view showing a layer structure of a fixing belt.

FIG. 7 is a schematic view of a layer structure of the belt 1 includes the metal base layer 1*a* of about 20-40 mm in inner diameter. At an outer periphery of the base layer 1*a*, a heat-resistant rubber layer as an elastic layer 1*b* is provided. A thickness of the rubber layer 1*b* may preferably be set in a range of 100-800 μm. In this embodiment, the thickness of the rubber layer 1*b* is set at 1000 μm in consideration of reduction in warming up time by decreasing thermal capacity of the belt 1 and obtaining of a fixing image suitable when a color image is fixed. Further, at an outer periphery of the rubber layer 1*b*, as a surface parting layer 1*c*, a layer of a fluorine-containing resin material (e.g., PFA or PTFE) is provided.

In an inner surface side of the base layer 1*a*, in order to lower sliding friction between the belt inner surface and the temperature sensor TH, a slidable layer 1*d* having a high sliding property may also be provided in a thickness of 10-50 μm. Incidentally, as a material for the metal layer 1*a* of the fixing belt 1, iron alloy, copper, silver, or the like is appropriately selectable.

(2) Pressing Roller 2

The pressing roller 2 is 40 mm in outer diameter, and on a core metal 2*a* formed of metal, a rubber layer as an elastic layer 2*b* is formed, and at a surface thereof, a parting layer 2*c* is provided. The pressing roller 2 is rotatably supported and provided between left and right fixed lower side plates 62L and 62R of the fixing device chassis at left and right end portions of the core metal 2*a* via bearings 63L and 63R. The pressing roller 2 is disposed in parallel to the assembly 10 with respect to the longitudinal direction in a lower side of the heating assembly 10. At a leaf-side end portion of the core metal 2*a*, a pressing roller urging gear G is coaxially and integrally provided.

(3) Pressing Urging Members 9L and 9R

Between the pressure-receiving portions 6*a* of the left and right flange members 6L and 6R of the heating assembly 10 and left and right fixed spring-receiving members 64L and 64R positioned and provided above the flange members 6L and 6R, respectively, left and right stay-pressing (urging) members 9L and 9R as the pressing urging members are compressedly provided.

By predetermined compression reaction forces of the pressing springs 9L and 9R, together with the left and right flange members 6L and 6R of the heating assembly 10, the stay 4 and the pad 3 are equally pressed down in left and right sides. Then, the pad 3 is press-contacted to an upper surface of the pressing roller 2 with a predetermined pressing force against elasticity of the elastic layer 2*b* via the belt 1. By this press contact, between the belt 1 and the pressing roller 2, the fixing nip N having a predetermined width with respect to the recording paper conveyance direction a is formed. The pad 3 assists formation of a pressure profile of the nip portion N.

(4) Coil Unit 40

The coil unit 40 is a heating source (induction heating means) for heating the belt 1 by electromagnetic induction, and is fixed and provided between the left and right fixed upper side plates 61L and 62R of the fixing device chassis in the upper side of the heating assembly 10. With respect to the coil unit 40, inside a housing 41 which is long in a left-right direction and which is an electrically insulating resin molded product as a coil holding member, an exciting coil (coil for generating the magnetic flux) 42 and an outer magnetic core 43 are provided.

A bottom plate 41*a* side of the housing 41 is an opposing surface to the outer surface of the belt 1. The bottom plate 41*a* is curved, in cross section, toward the inside of the housing 41 so as to follow an outer peripheral surface of the belt 1 in a substantially upper-half circumferential range. The housing 41 opposes the upper surface of the belt 1 with a predetermined gap (spacing) in the bottom plate 41*a* side, and is fixed and provided between the upper side plates 61L and 61R.

The coil 42 uses Litz wire as electric wire, and is formed in an elongated (ship's) bottom-like shape and is wound so as to oppose an almost peripheral surface of and a part of a side surface of the belt 1. Further, the coil 42 is abutted against the inner surface of the bottom plate 41*a* curved inside the housing 41, thus being accommodated inside the housing 41. To the coil 42, a high-frequency current of 20-60 kHz is applied from a power source unit (or device) (exciting device) 101 controlled by a controller (control circuit portion: control means) 100.

The external (outside) magnetic core 43 is provided to cover the outside of the coil 42 so that the magnetic flux generated by the coil 42 is prevented from being substantially leaked to a portion other than the metal layer (electroconductive layer) 1*a* of the belt 1. The core 43 is, as shown in FIG. 6, provided along the longitudinal direction of the coil 42 and is divided into a plurality of portions which are arranged in parallel with respect to a direction (longitudinal direction of the coil 42) perpendicular to the recording paper conveyance direction a, and is constituted so as to surround a winding central portion of the coil 42 and its periphery.

Further, in this embodiment, as shown in FIG. 6, a constitution in which each of individual divided cores of the core 43 divided in the plurality of portions with respect to the direction perpendicular to the recording paper conveyance direction a is further divided into 3 portions is employed. That is, the constitution in which the individual divided core is divided into the 3 portions consisting of a central more portion 43*a* corresponding to the winding central portion of the coil 42, and a front-side core portion 43*b* and a rear-side core portion 43*c* in front and rear sides, respectively, the central core portion 43*a* is employed. It is also possible to employ an integral shape of the central core portion 43*a*, the front-side core portion 43*b* and the rear-side core portion 43*c* without dividing the core 43 into the 3 portions.

An upper-side cover plate 61*b* of a housing 61 is provided. FIG. 6 is a schematic perspective view of a principal part of the device A in a state in which the cover plate 61*b* is removed to shown the inside of the coil unit 40 (housing 61).

(5) Magnetic Flux Suppressing Members 52L and 52R and Moving Mechanisms 50 and 51

The magnetic flux suppressing members 52L and 52R are members for reducing (blocking) the magnetic flux acting from the coil 42 onto the belt 1 in a region where there is the magnetic flux between the coil 42 and the belt 1. That is, the magnetic flux suppressing member is a magnetic flux adjusting means for adjusting the magnetic flux by being moved to an adjusting position where the magnetic flux acting in a non-sheet-passing portion region of the belt 1 when recording paper having a width smaller than a maximum sheet width, of recording paper capable of being passed through the device A, with respect to the widthwise direction perpendicular to the recording paper conveyance direction a.

The magnetic flux suppressing members 52L and 52R are movement-controlled, depending on widthwise information of the recording paper passed through the device A, by a driving motor M2, a leading screw member (screw shaft) 50 and slidable member 51 (51L and 51R) as a connecting member, which are to be controlled by the controller (CPU) 100. These magnetic flux suppressing members 52L and 52R are moving mechanisms M2, 50 and 51, and movement control will be specifically described below in (7).

(6) Fixing Operation

In a stand-by state of the image forming apparatus, in the fixing device A, a fixing motor M1 is turned off and thus rotation of the pressing roller 2 is stopped. Electric energy supply to the coil 42 of the coil unit 40 is turned off.

The controller 100 turns on the fixing motor M1 on the basis of input of a print job start signal (image forming job start signal). As a result, a driving force of the fixing motor M1 is transmitted to the pressing roller driving gear G via a drive transmitting mechanism (not shown), so that the pressing roller 2 is rotationally driven in the counterclockwise direction of an arrow R2 in FIG. 5 at a predetermined speed.

By the rotation of the pressing roller 2, a rotational force acts on the belt 1 by a frictional force between the surface of the pressing roller 2 and the surface of the belt 1 at the fixing nip N. The belt 1 is rotated by the rotation of the pressing roller 2 in the clockwise direction of an arrow R1 at the same speed as the rotational speed of the pressing roller 2 around the stay 4, the pad 3 and the core 5 while sliding on the pad 3 in a state in which its inner surface closely contacts the lower surface of the pad 3. Movement of the belt 1 in a longitudinal direction of the belt 1 with the rotation of the belt 1 is regulated (limited) by flange portions of the left and right flange members 6L and 6R.

The belt 1 is rotated as described above by the rotational drive of the pressing roller 2 through the driving motor M1 controlled by the controller 100 at least during execution of the image formation. This rotation is performed at a peripheral speed substantially equal to a conveyance speed of the recording paper P carrying an unfixed toner image T conveyed from the image forming portion side. In this embodiment, a surface rotational speed of the fixing belt 1 is 200 mm/sec and it is possible to fix the full-color image on 50 sheets per minute for A4 size and on 32 sheets per minute for A4R size.

The controller 100 supplies an AC current (high-frequency current) of, e.g., 20 kHz to 60 kHz from the power source unit 101 to the coil 42. The coil 42 generates AC magnetic flux (magnetic field) by the supply of the AC current. The AC current is induced by the core 43 into the metal layer 1*a* of the belt 1 in the upper side of the rotating belt 1. Then, eddy current is generated in the metal layer 1*a*, and by Joule heat due to the eddy current, the metal layer causes self-heat generation (electromagnetic induction heat generation), so that the belt 1 is increased in temperature.

That is, when the rotating belt 1 passes through a region where there is the magnetic flux generated from the unit 40, the metal layer 1*a* generates the heat by electromagnetic induction, so that the belt 1 is heated through its full circumference to be increased in temperature. In this embodiment, the belt 1 and the coil 42 of the unit 40 are maintained in an electrically insulated state by a mold (housing bottom plate) 61*a* of about 2 mm in thickness, so that the belt 1 and the coil 42 are disposed with a certain distance, and the belt 1 is uniformly heated.

The temperature of the belt 1 is detected by the temperature sensor TH. The sensor TH detects the temperature of the belt 1 at a portion corresponding to a sheet passing region, and detected temperature information is fed back to the controller 100. A temperature control functional portion of the controller 100 controls electric power (energy) to be supplied from the power source unit 101 to the coil 42 so that a detected temperature (information on the detected temperature) inputted from the sensor TH is maintained at a predetermined target temperature (fixing temperature: information on a predetermined temperature).

That is, in the case where the detected temperature of the belt 1 is increased to the predetermined temperature, electric energy supply to the coil 42 is interrupted. In this embodiment, temperature adjustment is effected by changing the frequency of the high-frequency current on the basis of a detected value of the sensor TH so that the temperature is kept at a constant temperature of 180° C. which is the target temperature of the belt 1, thus controlling the electric power to be inputted into the coil 42.

In a state in which the roller 2 is driven as described above and the belt 1 is increased in temperature up to the predetermined fixing temperature and is temperature-controlled at the predetermined fixing temperature, the recording paper P carrying thereon the unfixed toner image T is guided and introduced by a guide member 65 into the nip N with its toner image carrying surface toward the fixing belt 1. Then, the recording paper P is intimately contacted to the outer peripheral surface of the belt 1 in the nip N and is nip-conveyed together with the belt 1 through the nip N.

As a result, the heat of the belt 1 is principally provided to the recording paper P and the pressure of the nip N is applied to the recording paper P, so that the unfixed toner image T is heat-fixed on the surface of the recording paper P. The recording paper P passing through the nip N is self-separated (curvature-separated) from the outer peripheral surface of the belt 1 by deformation of the surface of the belt 1 at an exit portion of the nip N, thus being conveyed to the outside of the fixing device A.

The coil unit 40 including the exciting coil 42 is not disposed inside the belt 1 to be heated to the high temperature but is disposed outside the belt 1 and therefore it is difficult for the temperature of the coil 42 to become the high, so that the electric resistance is also not increased, and thus it is possible to alleviate loss due to the Joule heat generation even when the high-frequency current is passed through the coil 42. Further, the coil 42 disposed outside the belt 1 also contributes to a small diameter (low thermal capacity) of the belt 1, so that it can be said that the coil 42 is consequently excellent in energy saving property.

Figure 5:
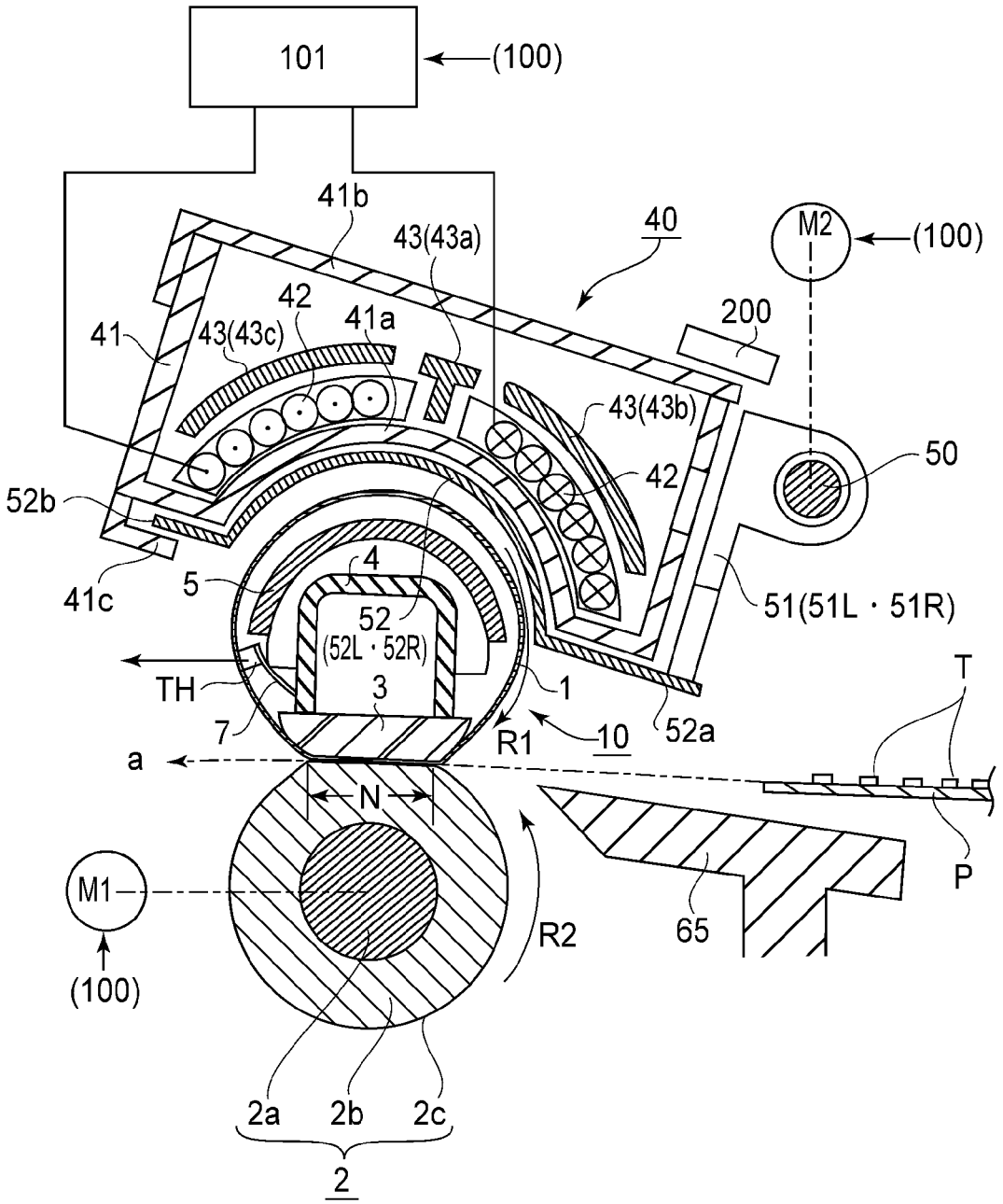
FIG. 5 is an enlarged schematic cross-sectional view of the principal part of the fixing device.

In the fixing device A in this embodiment, as shown in FIG. 5, in a cross section, the coil unit 40 is provided by being inclined toward a recording paper entrance of the fixing nip N with respect to the heating assembly 10. As a result, an induction-heated portion of the belt 1 by the coil unit 40 is caused to approach the fixing nip N as close as possible with respect to the rotational direction of the belt 1, so that heat efficiency is improved.

(7) Suppression of Non-Sheet-Passing-Portion Temperature Rise

As already described above, when sheets of the small-sized recording paper (narrower in width than the maximum width of the recording material usable in the device) are continuously passed and subjected to fixing in a large amount (during a job in which the unfixed toner image is continuously fixed on a plurality of sheets of the small-sized recording paper), a so-called non-sheet-passing-portion temperature rise can be generated. An operation of the magnetic flux suppressing member in which a distribution of heat generation of the fixing device A with respect to the longitudinal direction is controlled depending on the recording paper width size in order to meet the non-sheet-passing portion temperature rise will be described.

The sheet passing (conveyance) of the recording paper P through the fixing device A is made in this embodiment on a so-called center (line) basis using a width center of the recording paper as the center of the sheet passing. In FIGS. 3 and 4, a line O represents a center reference line (phantom line). A width W1 represents the maximum size width of the recording paper usable in the sheet passing through the device A, and a width W2 represents a minimum size width of the recording paper usable in the sheet passing through the device A.

In the coil unit 40, the maximum width of the whole of the outside magnetic core 43, which influences the heat generation width of the belt 1 and which is divided into a plurality of portions and disposed with respect to a longitudinal direction, is W1 so as to meet the maximum size with W1 of the recording paper P.

Further, in this embodiment, as the magnetic flux adjusting means for meeting various width sizes of recording papers (the maximum size width W1 to the minimum size width W2), the magnetic flux suppressing members 52 (52L and 52R) are used. The magnetic flux suppressing member 52 has a magnetic shield function (also referred to as a magnetic flux shielding members) and may also be non-magnetic metal such as aluminum, copper, silver, gold or brass or its alloy or may also be a high-permeability material such as ferrite or permalloy.

The magnetic flux suppressing member 52 is a member for suppressing, in a region where there is the magnetic flux between the coil 42 of the coil unit 40 and the belt 1, a part of the magnetic flux acting from the coil 42 toward the belt 1. That is, with respect to the widthwise direction perpendicular to the recording paper conveyance direction a, the magnetic flux suppressing member 52 is a means for adjusting the magnetic flux by being moved to an adjusting position (magnetic flux suppressing position), where the magnetic flux acting in the non-sheet-passing-portion region of the belt 1 is to be decreased, when the recording paper having a width narrower than the maximum size width of the recording paper capable of being passed.

In the device A in this embodiment, the sheet passing of the recording paper P is made on the center (line) basis and therefore the pair of magnetic flux suppressing members 52, i.e., 52L and 52R is disposed in left and right sides of the device A, respectively. With respect to an arrangement position of the magnetic flux suppressing members 52, it would be considered that the magnetic flux suppressing member 52 is disposed between the coil 42 and the outside magnetic core 43, between the coil 42 and the belt 1 or between the belt 1 and the inside magnetic core 5. In this embodiment, a copper plate was used as the magnetic flux suppressing member 52 and was inserted between the coil 42 and the belt 1.

Figure 8:
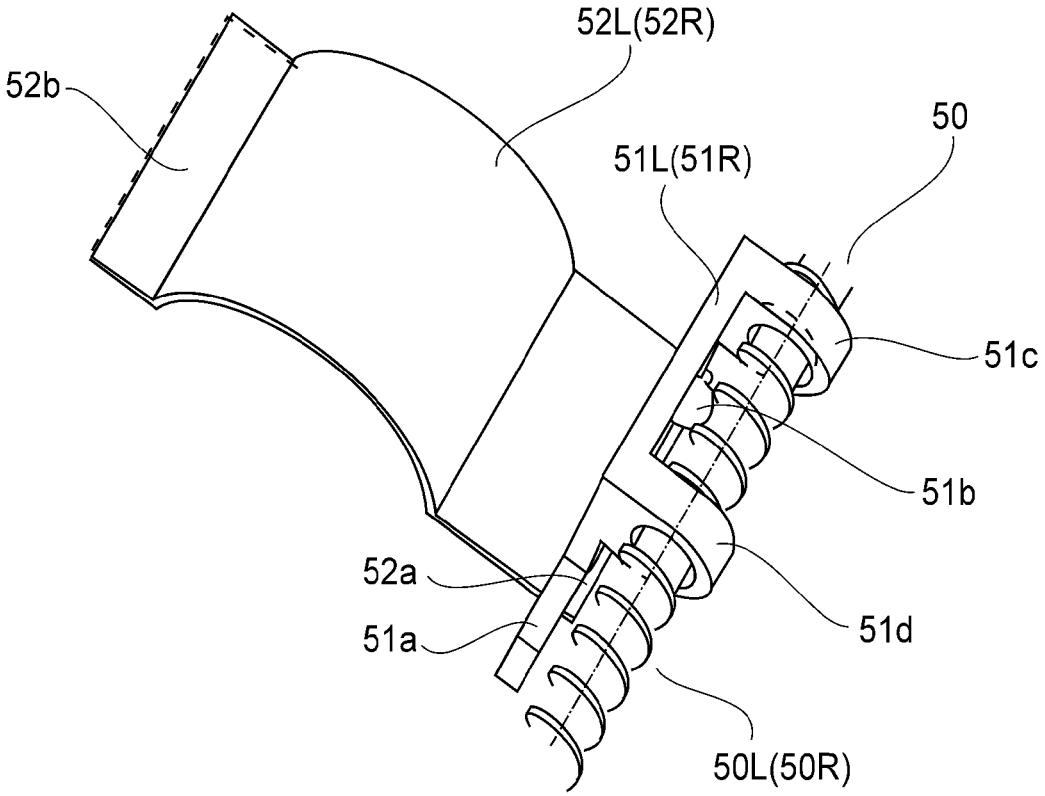
FIG. 8 is a detailed view of a movable portion of the magnetic flux suppressing member.

That is, in the device A in this embodiment, the pair of magnetic flux suppressing members 52 (52L and 52R) is disposed in the left and right sides of the belt 1 in a gap formed between the coil unit 40 and the belt 1. As shown in FIGS. 5 and 8, each of the magnetic flux suppressing members 52L and 52R is a member processed by bonding a band plate-like copper plate in a substantially arcuate shape so as to follow a substantially half-circumferential range of the outer peripheral surface of the belt 1. By the insertion of the magnetic flux suppressing members 52L and 52R, there is an effect of weakening passing of the magnetic flux, formed by the coil 42 and the outside magnetic core 43, through the heat generating layer 1*a* of the belt 1.

The left and right magnetic flux suppressing members 52L and 52R are subjected to positional movement control with respect to the longitudinal direction (left-right direction) of the device A by the moving mechanism. That is, the magnetic flux suppressing members 52L and 52R are movement-controlled between an initial position (retracted position or home position) and the adjusting position (effective position). The initial position is a position which is not located in the region where there is the magnetic flux. The adjusting position is a position for permitting a lowering of temperature in the non-sheet-passing-portion region of the belt 1 when the small-sized recording paper, having the width smaller than the maximum width of a large-size recording paper, is passed through the device A.

By moving the magnetic flux suppressing members 52L and 52R in the longitudinal direction of the device A, a distribution of longitudinal heat generation depending on the width size of the recording paper P to be passed through the device A is controlled.

The longitudinal width 52W (F1: width with respect to the direction crossing the recording paper conveyance direction) of each of the left and right magnetic flux suppressing members 52L and 52R is not more than a width in which the magnetic flux suppressing member 52L (52R) is able to be disposed at a differential position located between the left (right) fixed upper side plate 61L (61R) of the fixing device chassis and an inner diameter portion longitudinal end of the coil 42. This is based on three reasons such that a sufficient width in which a magnetic flux shielding effect is achieved is provided, that a maximum heat generation width W1 corresponding to a maximum size width of the recording paper is not decreased, and that the magnetic flux suppressing member 52 can be disposed without enlarging the longitudinal width of the fixing device A.

In order to sufficiently achieve the magnetic flux shielding effect, with respect to the width in the direction crossing the recording paper conveyance direction a, a relationship between a longitudinal width 52W of the magnetic flux suppressing members 52L and 52R and a longitudinal width 43W of the outside magnetic core 43 which is divided is 52W>43W. There is because when this condition is not satisfied, i.e., when the width 52W is smaller than the width 43W, a reducing effect of a degree of the recording-paper-end-portion temperature rise becomes small, and therefore the width 52W is set (defined) so as to be larger than the width 43W of the outside magnetic core 43 which is divided.

Figure 1:
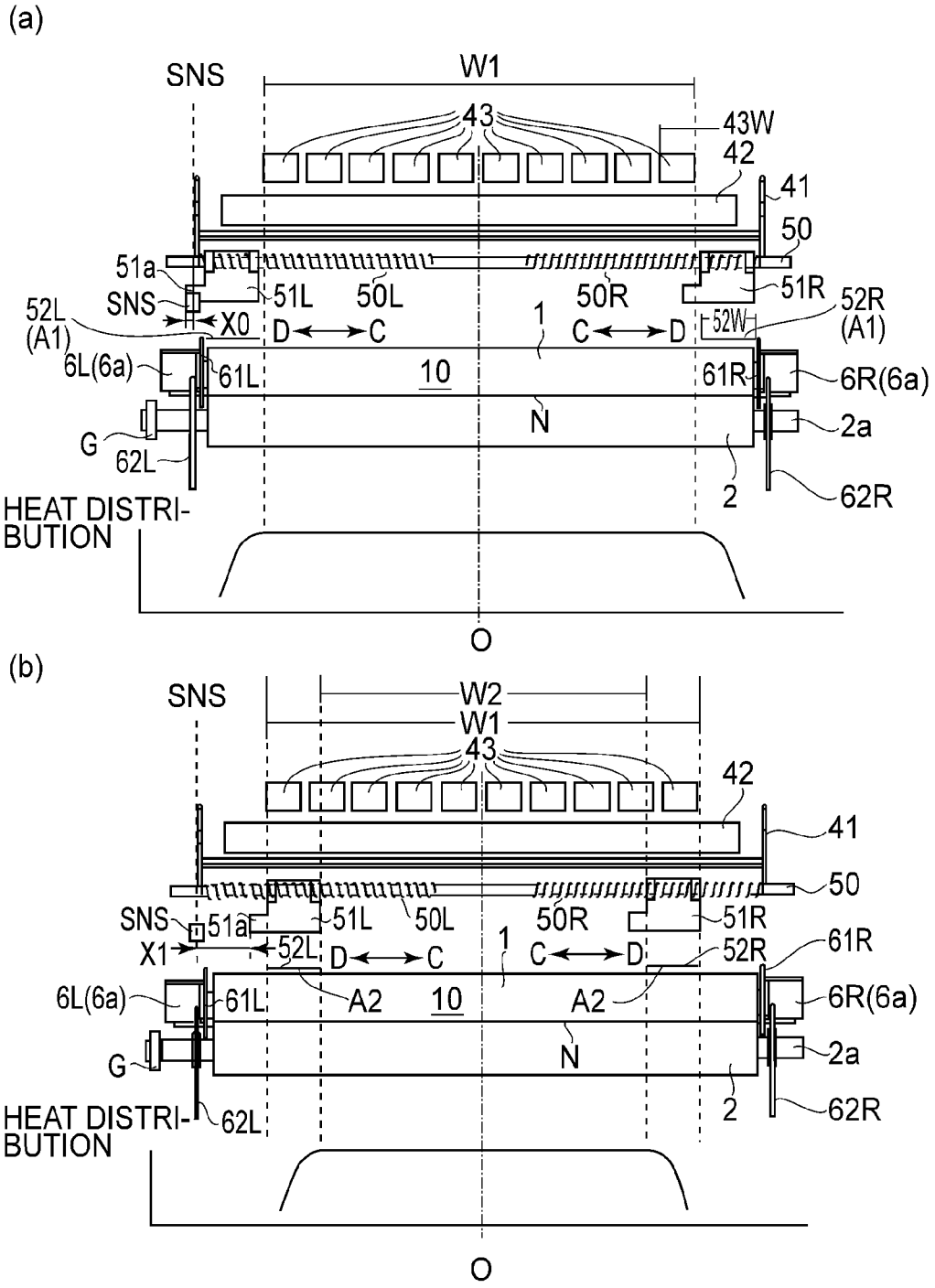

Parts (a) and (b) of FIG. 1 are exploded views of constituent members of the fixing device A, wherein (a) shows a state in which each of the left and right magnetic flux suppressing members 52L and 52R is located at an initial position A1, and (b) shows a state in which each of the left and right magnetic flux suppressing members 52L and 52R is moved to an adjusting position A2 corresponding to a position during sheet passing of recording paper having the minimum size width W2.

Each of the left and right magnetic flux suppressing members 52L and 52R is, as shown in (a) of FIG. 1, disposed outside the region of the maximum size width W1 of the recording paper to ensure the heat generation distribution corresponding to the maximum size width W1. This position is the initial position (retracted position) A1. The initial position A1 of each of the magnetic flux suppressing members 52L and 52R is deviated (retracted) from the region (where the coil 42 and the belt 1 oppose each other) in which there is the magnetic flux between the coil 42 and the belt 1.

During sheet passing of the recording paper having the minimum size width W2, the left and right magnetic flux suppressing members 52L and 52R are moved in an arrow direction C from the initial position A1 shown in (a) of FIG. 1 to the adjusting position A2 shown in (b) of FIG. 1. In (b) of FIG. 1, the magnetic flux suppressing members 52L and 52R are inserted into end portions inside the heat generation width W1 formed by the magnetic flux shielding outside magnetic core 43 which is divided, whereby the magnetic flux passed through the belt 1 is weakened, and thus the heat generation distribution corresponding to the minimum size width W2 of the recording paper is formed.

Next, the moving mechanism for the magnetic flux suppressing members 52L and 52R will be described. As shown in FIG. 5, the magnetic flux suppressing members 52L and 52R are disposed between the belt 1 and the coil 42 and are held, in a base portion side 52*a* by slidable members 51L and 51R movable in the longitudinal direction of the device A. The magnetic flux suppressing members 52L and 52R are held by the slidable members 51L and 51R so that the magnetic flux suppressing members 52L and 52R to be moved in the longitudinal direction of the device A and the rotating belt 1 do not contact each other.

In this embodiment, by providing the housing 41 of the coil unit 40 with a stopper member 41*c* for receiving a free end portion 52*b* of each of the magnetic flux suppressing members 52L and 52R, the magnetic flux suppressing members 52L and 52R are prevented from contacting the belt 1.

As a holding method of the magnetic flux suppressing members 52L and 52R, a constitution in which the slidable members 51L and 51R and the magnetic flux suppressing members 52L and 52R are integral with each other and a constitution in which the magnetic flux suppressing members 52 are contacted to the housing 41 in order to ensure a clearance from the belt 1 may also be employed. The present invention does not define a holding method of the slidable members 51 and the magnetic flux suppressing members 52. The slidable members 51L and 51R which hold the magnetic flux suppressing members 52L and 52R are disposed symmetrically at longitudinal end portions of the device A with respect to a center reference line O of the sheet passing of the recording paper P.

Between the left and right fixed upper side plates 61L and 61R of the fixing device chassis, in a front side of the coil unit 40, a leading screw member 50 is arranged in parallel to the housing 41 and is disposed while being rotatably supported by bearings 61*a* of the plates 61L and 61R (FIGS. 3 and 6). This leading screw member 50 includes a screw portion 50L in a left-half side and a screw portion 50R in a right-half side which are screws opposite in helical direction to each other. The bearings 61*a* may also be durable bearing members provided separately.

The left and right slidable members 51L and 51R which are connecting portions are threadably mounted on the left-side screw portion 50L and the right-side screw portion 50R, respectively, of the leading screw member (screw shaft) 50. The left and right slidable members 51L and 51R which hold the left and right magnetic flux suppressing members 52L and 52R are supplied with a driving force from the leading screw member 50 to be moved in a line-symmetrical manner with respect to the center reference line O of the sheet passing of the recording paper P.

The leading screw member 50 is rotationally driven in a normal rotational direction RC shown in FIG. 6, so that the left and right slidable members 51L and 51R are moved in an arrow C direction. On the other hand, the leading screw member 50 is rotationally driven in a reverse rotation direction RD, so that the left and right slidable members 51L and 51R are moved in an arrow D direction.

As shown in FIG. 8, each of the left and right screw portions 50L and 50R of the leading screw member 50 is externally engaged with a cylindrical portions 51*c* and 51*d* of the left and right slidable member 51L or 51R, so that a boss portion 51*b* is engaged with the screw portion 50L or 50R. Here, the cylindrical portions 51*c* and 51*d* externally engaged with the screw portion 51L or 51R may also have a shape such that they contact the screw portion 51L or 51R at three or more points so as to reduce a contact portion area with the screw portion 51L or 51R.

The leading screw member 50 is subjected to rotational drive control in the normal rotational direction RC or the reverse rotational direction RD by transmitting, thereto via a drive transmitting mechanism (not shown), a normal rotational force or a reverse rotational force of a driving motor (e.g., stepping motor) M2 controlled by the controller 100.

In a state in which the left and right magnetic flux suppressing members 52L and 52R are located at the initial position A1 of (a) of FIG. 1, when the leading screw member 50 is normally rotated and driven, each of the left and right magnetic flux suppressing members 52L and 52R is moved toward a central portion of the belt 1 by the same movement amount. That is, the spacing between the left and right magnetic flux suppressing members 52L and 52R is narrowed on the center reference line basis.

By controlling the normal rotational amount of the leading screw member 50, the left and right magnetic flux suppressing members 52L and 52R are moved to the adjusting positions A2 for permitting lowering of the temperature at the non-sheet-passing portions when the small-sized recording paper having a width smaller than the maximum width W1 of the large-sized recording paper capable of being passed through the device A. Each of the adjusting positions A2 is a different position corresponding to each of various widths of the small-sized recording papers.

Further, in a state in which the spacing between the left and right magnetic flux suppressing members 52L and 52R is narrowed, when the leading screw member 50 is reversely rotated and driven, the left and right magnetic flux suppressing members 52L and 52R are moved toward the initial positions A1 in the left and right end portion sides of the belt 1 by the same movement amount. That is, the spacing between the magnetic flux suppressing members 52L and 52R is broadened.

The above-described motor M2, the leading screw member 50, and the slidable members 51L and 51R constitute the moving mechanism (driving means or shift mechanism) for causing the left and right magnetic flux suppressing members 52L and 52R to perform a reciprocation movement operation between the initial position A1 and the adjusting position A2.

In this embodiment, as the moving mechanism for moving the magnetic flux suppressing members 52L and 52R in the longitudinal direction of the device A, the slidable members 51L and 51R and the leading screw member 50 are used but the moving mechanism is not limited thereto. It is also possible to employ a moving mechanism using a wire so long as the moving mechanism has a movement constitution in which the magnetic flux suppressing members 52L and 52R are symmetrically moved toward the longitudinal end portions with respect to the center reference line O of the sheet passing of the sheet passing of the recording paper P.

Next, control of an operation of the magnetic flux suppressing members 52L and 52R with respect to various paper sizes (W1 to W2) will be described.

As shown in FIGS. 1 and 3, as a control means of the operation of the magnetic flux suppressing members 52 (52L and 52R), the driving motor M2 for driving the leading screw member 50 is provided, and as a position detecting means of the magnetic flux suppressing members 52, a sensor SNS is provided. Further, the controller (executing portion) 100 for controlling an operation of the driving motor M2 on the basis of a signal of the sensor SNS is provided.

The sensor SNS is a photo-interruptor and effects ON and OFF of light blocking by a flag portion 51*a* provided on the left-side slidable member 51L. In view of a variation in the drive, such as backlash, to be transmitted from the driving motor M2 to the leading screw member 50, an edge of the flag portion 51*a* is detected by the sensor SNS, and then positional control of the magnetic flux suppressing member 52 is effected.

The controller (executing portion) 100 reads a signal of an operating portion 102 (FIG. 3) provided on the image forming apparatus and a signal (information on a size width of the recording paper to be passed through the device A) of a recording paper size inputting means 104 of an external host device 103 such as a computer. Then, on the basis of the signals and the signal of the sensor SNS, the controller 100 controls the driving motor M2.

Figure 9:
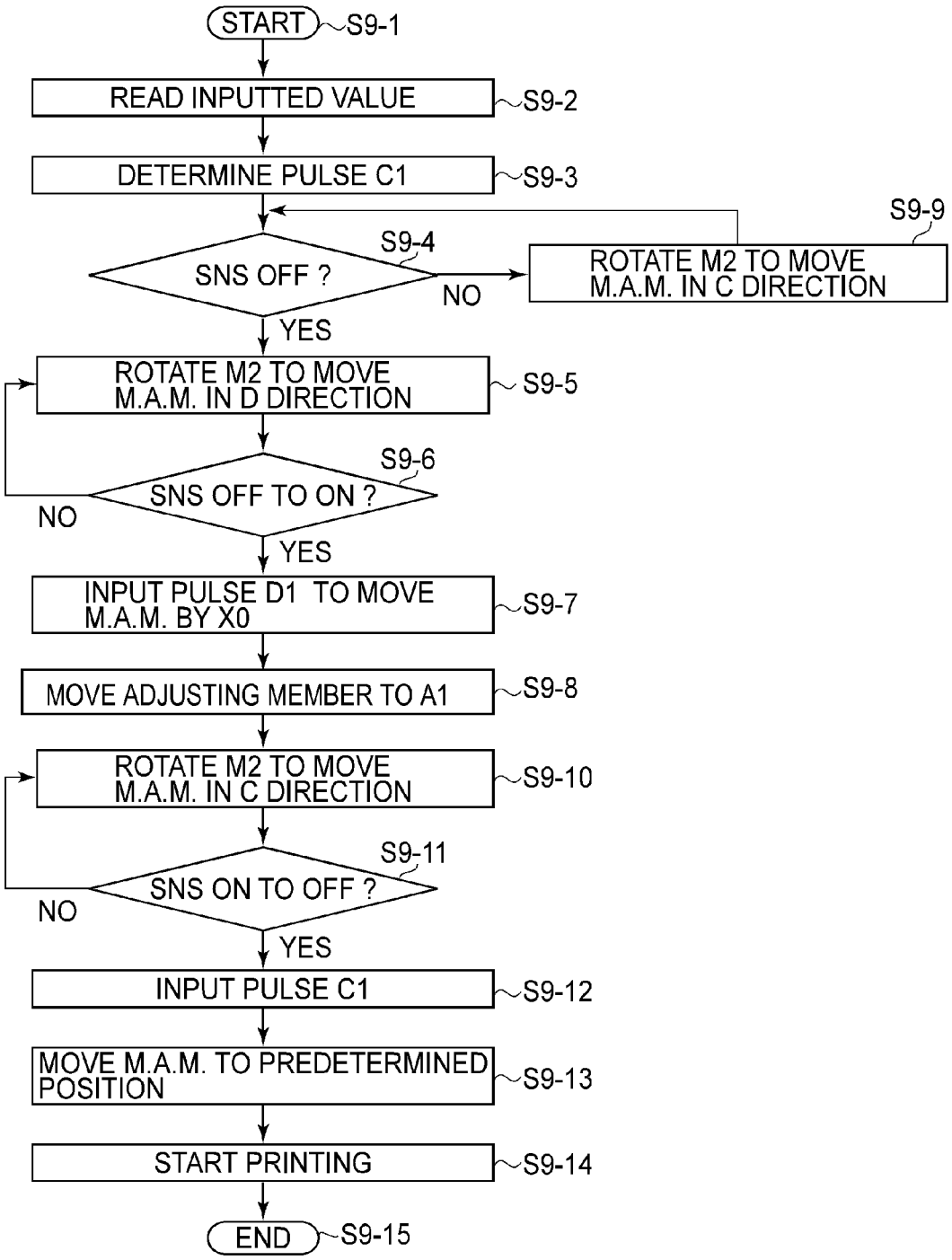
FIG. 9 is a flowchart of movement control of the magnetic flux suppressing member during sheet passing of a recording material.

FIG. 9 is a flowchart of operation control of the magnetic flux suppressing members 52L and 52R in this embodiment. With reference to FIG. 9, the operation of the sensors 51 (51L and 51R) for holding the magnetic flux suppressing members 52 (52L and 52R) will be described by taking, as an example, the case where the size width of the recording paper P to be passed through the device A is the minimum size width W2.

When a print job is started (S9-1), the controller 100 reads an input value of the recording paper size from the recording paper size inputting means 104 (S9-2). Correspondingly to the input value of the recording paper size, by computation of the controller 100, a pulse number C1 to be inputted into the driving motor M2 at the initial position A1 ((a) of FIG. 1) of the magnetic flux suppressing member 52 is determined (S9-3).

The controller 100 reads the signal of the sensor SNS (S9-4), and depending on an ON/OFF state of the sensor SNS, returns the magnetic flux suppressing member (magnetic flux adjusting means ("M.A.M.")) 52 to the initial position A1 shown in (a) of FIG. 1 by using the driving motor M2 and sensor SNS.

First, when the sensor SNS is in an OFF state, the magnetic flux suppressing member 52 is not located at the initial position A1 but is shifted toward a central side with respect to a direction perpendicular to the recording paper conveyance direction a, and therefore the magnetic flux suppressing member 52 is moved to the position shown in (a) of FIG. 1 (S9-5).

By reversely rotating and driving the driving motor M2, the magnetic flux suppressing member 52 is moved in an arrow D direction. Passing (sensor SNS signal changed from OFF to ON) of the flag 51*a*, provided on the slidable member 51, through a detection position of the sensor SNS is detected (S9-6). After the detection, a recording paper pulse D1 is inputted into the driving motor M2. As a result, at a position to which the magnetic flux suppressing member 52 is moved by X0, an operation of the magnetic flux suppressing member 52 is ended (S9-7), and the magnetic flux suppressing member 52 is moved to the initial position A1 (S9-8).

On the other hand, when the signal of the sensor SNS is an ON state, the driving motor M2 is normally rotated and driven so that the magnetic flux suppressing member 52 is moved in an arrow C direction (S9-9). Then, when switching (ON to OFF) of the signal of the sensor SNS is recognized (S9-4), the driving motor M2 is reversely rotated and driven, so that the magnetic flux suppressing member 52 is moved in the D direction (S9-5).

Thereafter, the flag portion 51*a* provided on the slidable member 51 passes through the detection position of the sensor SNS (i.e., the sensor SNS signal is changed from OFF to ON) (S9-6), and then the predetermined pulse D1 is inputted into the driving motor M2 (S9-7). As a result, at the position to which the magnetic flux suppressing member 52 is moved by X0, the operation of the magnetic flux suppressing member 52 is ended, and then the magnetic flux suppressing member 52 is moved to the initial position A1 (S9-8).

By rotating the driving motor M2, the magnetic flux suppressing member 52 is moved in an arrow D direction (S9-10). Passing (sensor SNS signal changed from ON to OFF) of the flag 51*a*, provided on the slidable member 51, through a detection position of the sensor SNS is detected (S9-11). After the detection, a recording paper pulse C1 is inputted into the driving motor M2 (S9-12). As a result, at a position to which the magnetic flux suppressing member 52 is moved by X1 shown in (b) of FIG. 1, an operation of the magnetic flux suppressing member 52 is ended (S9-13), and printing is started (S9-14). Then, the control operation of the magnetic flux suppressing member is ended (S9-15).

As a result, in recording paper sheet passing corresponding to the minimum size width W2, it is possible to form a heat generation distribution such that non-sheet-passing portion temperature rise and end portion improper fixing are not induced.

Further, when the recording paper size is the maximum size width W1, the pulse C1 to be inputted into the driving motor M2 is zero, and then the printing is started without moving the magnetic flux suppressing member 52 from the initial position A1.

Further, with respect to recording paper, having a longitudinal width W (W1>W>W2), to be passed through the fixing device A, the following operation is performed. That is, correspondingly to the input value of the longitudinal width W of the recording paper, by computation of the controller 100, the recording paper pulse number C1 from the sensor SNS to be inputted into the driving motor M2 is changed. As a result, similarly as described above, it is possible to form the heat generation distribution, corresponding to the longitudinal width W of the recording paper, without inducing the non-sheet-passing-portion temperature rise and the end portion improper fixing.

The above-described control is summarized as follows. The controller 100 executes, during a heating job in which the recording paper is passed through and heated by the fixing device A, an operation in a moving mode during sheet passing in which the moving mechanism (M2, 50 and 51) is controlled to move the magnetic flux suppressing members 52L and 52R to the adjusting positions A2 depending on information on the size width of the recording paper P to be passed through the fixing device A.

(8) Countermeasure Against Wax (8-1) Wax Contained in Toner

In a toner T, a wax as a parting agent of 60-90° C. in melting point (temperature) is contained. Specifically, the toner T includes base material particles containing the wax of 60° C. or more and 90° C. or less in melting point and a binder resin. The base material particles are formed so that an endothermic amount, resulting from the wax, of an endothermal peak in DSC measurement is 3.5 J/g or more and 5.5 J/g or less and an average circularity is 0.950 or more and 0.980 or less.

Thus, by incorporating the wax, having the welting point in the range of 60-90° C., into the toner T, not only can the low temperature fixing property be improved, but also the separating property (toner parting property) of the recording paper P from the belt 1 and the pressing roller 2 can be enhanced without applying oil onto the belt 1.

(8-2) Adhesion of Wax

In the case where the toner containing the wax is used, the wax volatilized at the position of the nip N or at the surface or the like of the belt 1 adheres to and is accumulated at the surfaces of the screw portions 51L and 51R of the leading screw member 50 as the moving mechanism for the magnetic flux suppressing members 52L and 52R.

When a height of the accumulated wax exceeds the engaging spacing between an outer diameter portion of the screw portions 50L (50R) and the cylindrical portion 51*c* (51*d*) of the slidable member 51 (51L or 51R), an improper operation of the slidable member 51 is invited.

When the slidable member 51 for holding the magnetic flux suppressing member 52 causes the improper operation, a position of the magnetic flux suppressing member 52 corresponding to the paper size cannot be obtained, so that a problem such that excessive temperature rise at the non-sheet-passing portion or the improper fixing is caused can occur.

(8-3) Cleaning Job

Figure 10:
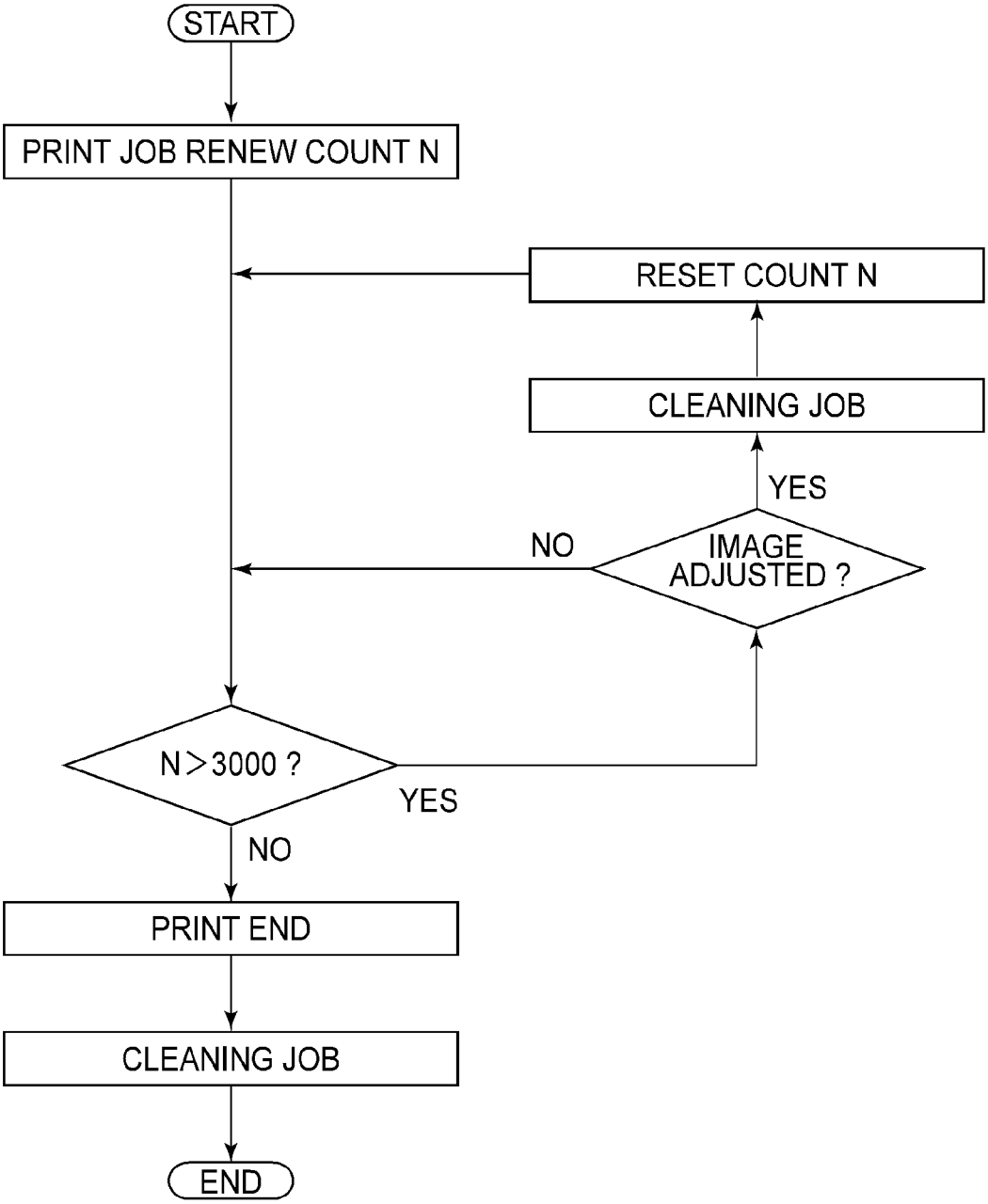
FIG. 10 is a flowchart of cleaning job control.

A cleaning job for cleaning the wax adhered to a movable portion of the above-described moving mechanism without requiring heat generation is performed, so that the adhered wax is removed to prevent the improper operation of the movable portion. FIG. 10 is a flowchart of cleaning job control in this embodiment.

The cleaning job is performed, in the case where the toner containing wax is used, for suppressing adhesion of the wax, volatilized at the position of the nip N or at the surface or the like of the belt 1, to the surfaces of the leading screw portions 50L and 50R. The cleaning job of the leading screw portions 50L and 50R and the slidable member 51 is performed by at least one reciprocation in a region ranging from the maximum size width W1 to the minimum size width W2 shown in (a) of FIG. 1.

Further, in the image forming apparatus, by the arrangement of the fixing device A shown below, a volatile matter of the wax generated in the neighborhood of the fixing device A is liable to adhere to the leading screw portions 50L and 50R. The reason therefor will be described with reference to FIG. 2.

In the image forming apparatus, in order to prevent heat conduction from the fixing device A to the image forming portions Y, C, M and K, at a boundary between the fixing device A and the image forming portions Y, C, M and K, an air flow portion F is provided. At the air flow portion F, flow of the air is provided by an unshown fan, so that the heat conduction from the fixing device A to the image forming portions Y, C, M and K is suppressed. By this flow of the air, the volatile matter of the wax generated in the neighborhood of the fixing device A is stagnated with no escape route.

Further, in order to solve this problem, when the air stagnated in the neighborhood of the fixing device A is intended to be exchanged by air flow, heat quantities of the fixing belt 1 and the pressing roller 2 are taken, so that the drawback of a large electric power consumption by the fixing device A is generated.

For this reason, the volatile matter of the wax generated and stagnated in the neighborhood of the fixing device A is liable to adhere to the leading screw portions 50L and 50R. There is also a method of moving the leading screw member 50, the slidable member 51 and the like, which are movable portions, away from the neighborhood of the fixing device A, but this solution increases the size of the image forming apparatus, which is disadvantageous.

Against the above-described problems, in this embodiment, the cleaning job for removing the wax adhered to the movable portions is performed. In the cleaning job, the slidable members 51 (51L and 51R) for holding the magnetic flux suppressing members 52 (52L and 52R) are reciprocated in movement regions each ranging from (end of) the maximum size width W1 to (end of) the minimum size width W2. As a result, slidable portions between the leading screw portions 50L and 50R and the slidable members 51 (51L and 51R) which are the movable portions are cleaned. This job is the cleaning job.

As timing when the cleaning job is performed is after the fixing job (job in which the recording paper (recording material) P is passed through the nip) or during image adjustment of the image forming apparatus performed, in a period other than the fixing job, depending on a predetermined count value of an integrated sheet passing number of the recording paper.

In FIG. 10, when the print job is started, a count N of an integrated print number is renewed. Depending on its count N of the sheets, the cleaning job is performed. In this embodiment, a trigger for the sheet number count N for performing the cleaning job is set at 3000 sheets. The reason why the trigger is set at 3000 sheets is as follows. In order not to impair productivity of the image forming apparatus, the timing of performing the cleaning job is a state in which the recording paper is not passed through the fixing device A. In this embodiment, the timing is interrelated with during the image adjustment, in the main assembly with respect to a minimum count sheet number of 3000 sheets, of the image adjustment.

First, in the case of a print job in which the sheet number count N does not exceed 3000 sheets, after the print job, the cleaning job is performed.

On the other hand, in the case where the sheet number count N exceeds 3000 sheets, at timing when the image forming apparatus main assembly starts the image adjustment (cleaning job of a charging shutter), the cleaning job is performed. After the cleaning job, the sheet number count N is reset to zero, and then the print job is performed again. Then, after the print job, the cleaning job is performed.

By employing the above-described constitution, the cleaning job for cleaning the wax adhered to the leading screw portions 50L and 50R and the slidable members 51 (51L and 51R) which are the movable portions for the magnetic flux suppressing members 52 (52L and 52R) is performed. As a result, the adhered wax can be removed, so that the improper operation at the movable portions for the magnetic flux suppressing members 52 can be prevented. As a result, it is possible to form a heat generation distribution, corresponding to respective recording paper sizes, without inducing the non-sheet-passing portion temperature rise and the end portion improper fixing.

The above-described control is summarized as follows. The controller 100 executes, in order to remove the wax adhered to the leading screw portions 50L and 50R and the slidable members 51 (51L and 51R) which are the movable portions for the magnetic flux suppressing members 52 (52L and 52R), a movement mode during non-sheet passing, as described below, during the non-sheet passing of the recording paper such as after the sheet passing of a predetermined sheet number. That is, the controller 100 controls the moving mechanism (M2, 50 and 51) to execute an operation in a control mode in which each of the magnetic flux suppressing members 52L and 52R is moved between the initial position A1 and the adjusting position A2 where the magnetic flux acting in the non-sheet-passing-portion region is decreased when the predetermined sheet number is reached for sheets having the minimum size width W2, capable of being passed through the fixing device.

The controller 100 performs, after a heating job for heating the recording paper by sheet passing, as an operation in the movement mode during non-sheet passing, a reciprocal movement operation at least once (one reciprocal movement) between the initial position A1 of each of the magnetic flux suppressing member 52L and 52R and the adjusting position A2 corresponding to the recording paper having the minimum size width W2.

The controller 100 executes, during the image adjustment at the image forming portions for forming the images on the recording paper to be passed through the fixing device, the operation in the movement mode during non-sheet passing. That is, the controller performs the reciprocal movement operation at least once between the initial position A1 of each of the magnetic flux suppressing members 52L and 52R and the adjusting position A2 corresponding to the recording paper having the minimum size width W2.

(8-4) Operation Speed of Cleaning Job

When the fixing device is continuously used, by the adhered wax, the sliding resistance between the leading screw portion 50L or 50R and the slidable member 51 (51L or 51R) becomes large. As a countermeasure thereof, the operation speed (rotational speed) of the driving motor M2 for driving the leading screw portion 50 may also be selectively changed between during a normal operation (during the operation in the movement mode during sheet passing) shown in FIG. 9 and during the cleaning job (during the operation in the movement mode during non-sheet passing) shown in FIG. 10.

In this embodiments during the cleaning job, in order to ensure an output torque of the driving motor M2 capable of withstanding the sliding load between the leading screw portion 50L (50R) and the slidable member 51L (51R), the driving motor M2 is used at an operation speed lower than the operation speed during the normal operation.

In this embodiment, a time t2 required for one reciprocation during the normal operation was 8 seconds, and a time t1 required for one reciprocation during the cleaning job was 18 seconds. The reason why the time t1 is 18 seconds is that a time t3 required for the image adjustment interrelated with the cleaning job is 20 seconds. Therefore, $t2<t2<T3$ is satisfied, so that a stepping motor is used as the driving motor M2 in order not to impair productivity in a period other than the image adjustment period, and is used by switching the operation speed between during the normal operation and during the cleaning job.

(8-5) Control of Driving Motor M2

As described above, in this embodiment, the toner having the wax melting point of 40° C. to 90° C. is used. When the fixing device is continuously used, by the adhered wax, the sliding resistance between the leading screw portion 50L (50R) and the slidable member 51L (51R) becomes large. During the operation of the image forming apparatus or the fixing device A, the temperature rise is generated in the apparatus (device) and therefore the temperature exceeds the melting point of the wax, so that the wax becomes a liquid. Therefore, by the above-described cleaning job, the improper operation can be prevented.

However, during the operation in a state in which the inside of the apparatus (machine) is cooled, the temperature is not more than the melting point of the wax and therefore a solidified state is generated. For example, in the case where the temperature in the apparatus is equal to an ambient temperature, such as the case where the main switch is turned on at start of the day after the apparatus is left standing overnight or the case of restoration from a sleep state for a long time, the wax is not more than the melting point in temperature and is solidified. In the solidified state of the wax, when the slidable member 51 slides on the leading screw portions 50L and 50R, the sliding resistance becomes larger.

In this embodiment, as shown in FIG. 5, an environment sensor 200 for detecting an inside temperature of the apparatus is disposed in the neighborhood of the leading screw portion. The controller 100 effects control of FIG. 11 in the case where the inside temperature detected by the environment sensor 200 is not more than the wax melting point, so that a value of a current to be supplied to the motor M2 is increased and thus a motor torque is increased. Further, in order to prevent an excessive temperature rise of the motor M2, the controller 100 effects, in the case where the inside temperature detected by the environment sensor 200 is not less than the wax melting point, control for returning the value of the current, to be supplied to the motor M2, to a normal current value.

Figure 11:
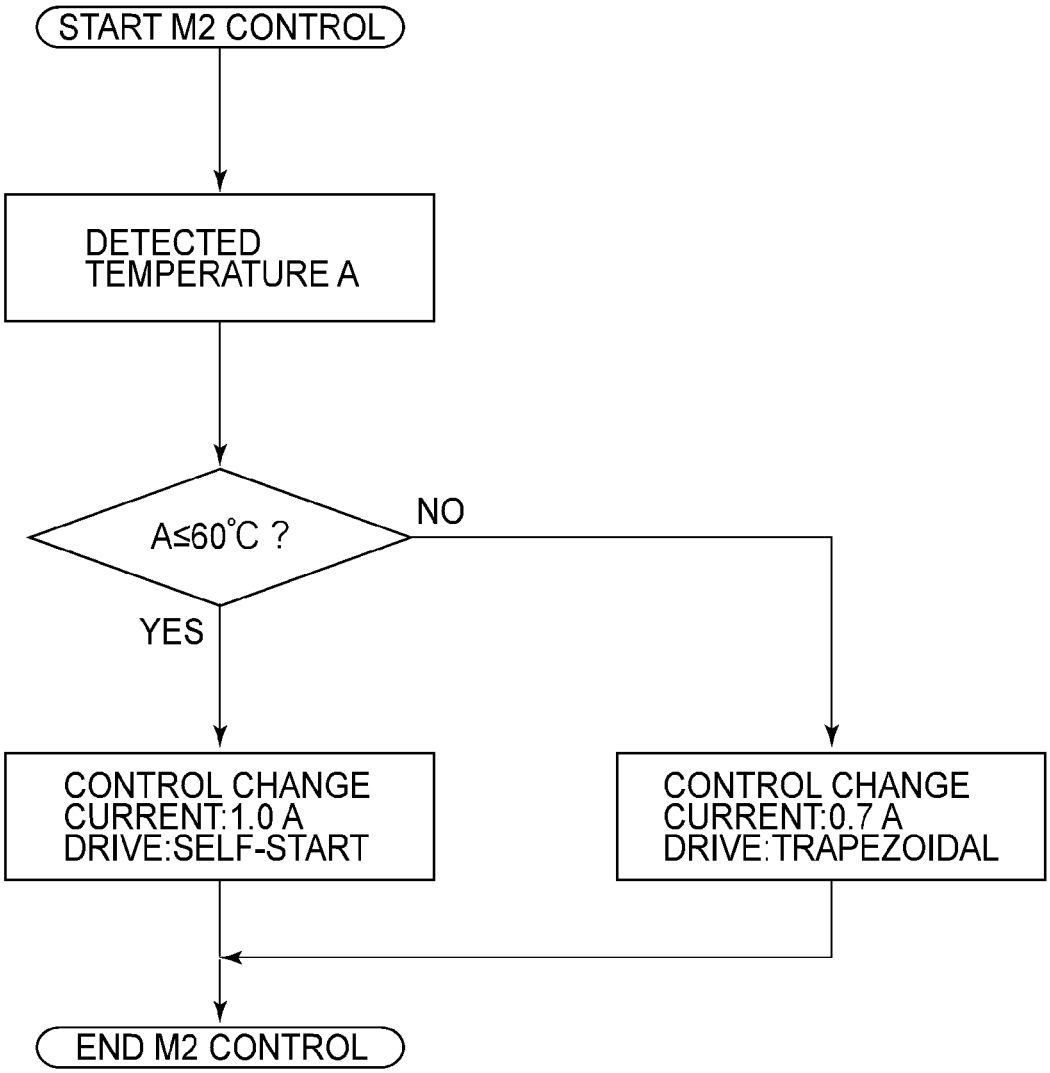
FIG. 11 is a flowchart of control change of a driving motor for a moving mechanism.

Incidentally, in FIG. 11, the melting point of the wax is set at 60° C. The controller 100 compares the melting point of the wax with the inside temperature of the apparatus detected by the environment sensor 200.

In this embodiment, in the normal operation, the current was 0.7 A and an on-shaft rated torque was 350 cN·cm, and at the start of the day, the current was 1.0 A and the on-shaft rated torque was 450 cN·cm which was about 1.3 times that in the normal operation. Further, in order to prevent loss of synchronism and excessive temperature rise of the motor, a control change (setting change) was made so that trapezoidal drive of 500 pps in the normal operation and self-start (actuation) of 300 pps were effected.

The above-described control is summarized as follows. When the controller 100 controls the moving mechanism (M2, 50 and 51) to move the magnetic flux suppressing members 52 (52L and 52R), in the case where the environment sensor 200 detects the temperature not more than the melting point of the wax, the controller increases the value of the current to be supplied to the motor M2 so as to be higher than the current value during the normal operation. The current value during the normal operation is a value of a current to be supplied to the motor M2 in the case where the environment sensor 200 detects a temperature higher than the wax melting point.

Incidentally, in this embodiment, in the operation in the movement mode during non-sheet passing, a constitution in which the magnetic flux suppressing member is reciprocated between the initial position A1 and the adjusting position A2 corresponding to the minimum size width W2 is employed. However, the present invention is not intended to be limited to this constitution.

1) In the operation in the movement mode during non-sheet passing, it is also possible to employ a constitution in which the magnetic flux suppressing member is reciprocated in a range wider than the range between the initial position A1 and the adjusting position A2 corresponding to the minimum size width W2.

2) Alternatively, in the operation in the movement mode during non-sheet passing, it is also possible to employ a constitution in which the magnetic flux suppressing member is reciprocated between an end portion and another end portion, with respected to the widthwise direction, of a movement region in which the magnetic flux suppressing member is movable.

Such a constitution is effective in the case where a further premium is placed on a cleaning property by the operation in the movement mode during non-sheet passing in the constitution in which the movement region in which the magnetic flux suppressing member is movable is broad.

Embodiment 2

In Embodiment 2, with respect to the image forming apparatus in Embodiment 1, a description regarding constitutions and operations of common portions will be omitted. In this embodiment, control is effected during turning-on of main power source (hard switch) of the image forming apparatus and during turning-on of a soft power source (soft switch) provided at an operating portion (liquid crystal display portion) provided for restoration (transition) from a sleep mode as a power saving mode or the like to an image formable state.

Figure 12:
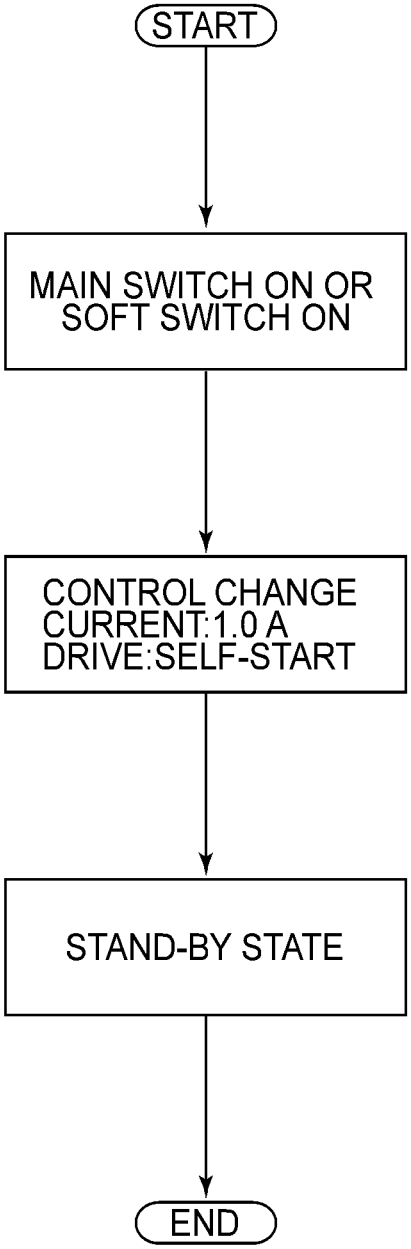
FIG. 12 is a flowchart of control change of a driving motor in Embodiment 2.

In a status in which the turning-on of the main power source or the soft power source is not detected in the image forming apparatus main assembly, the controller 100 cannot detect the inside temperature of the apparatus by the environment sensor 200, and therefore the controller 100 discriminates that the inside temperature of the apparatus is not more than the wax melting point and then effects control of the motor M2 as shown in FIG. 12.

That is, when the main power source of the apparatus or a power source for restoring the apparatus from the sleep state is turned on from a state in which the main power source or the power source is not turned on, the controller 100 is set, irrespective of the detection temperature of the environment sensor 200, such that the value of the current to be supplied to the motor M2 is increased so as to be higher than that during the normal operation similarly as in Embodiment 1.

Embodiment 3

In Embodiment 3, with respect to the image forming apparatus in Embodiment 1, a description regarding constitutions and operations of common portions will be omitted. In this embodiment, the cleaning job is intended to be performed with reliability, and as shown in FIG. 10 in Embodiment 1, the controller 100 is operable in the movement mode during non-sheet passing and set, irrespective of the detection temperature of the environment sensor 200, such that the value of the current to be supplied to the motor M2 is increased so as to be higher than that during the normal operation similarly as in Embodiment 1.

Other Embodiments

1) The belt member as the rotatable heating member 1 can also be formed in an endless belt member, having flexibility, which is extended and stretched around a plurality of stretching members and which is circulated and moved by the driving roller. The rotatable heating member 1 can also be formed in a roller member.

2) It is also possible to employ a device constitution of an internal heating type in which the coil unit 40 is provided inside the rotatable heating member 1.

3) The back-up member 2 for forming the nip N with the rotatable heating member 1 is not limited to a roller member. It is also possible to employ a rotatable endless belt member. Further, it is also possible to use the back-up member 2 in the form of non-rotatable member (pressing pad or the like) having a small friction coefficient at a surface (contact surface with the rotatable heating member 1 or the recording paper P). It is also possible to employ a constitution in which also the back-up member 2 is heated.

4) The sheet passing (conveyance) of the recording paper P through the device A is not limited to be effected on the center (line) basis. It is also possible to employ a device constitution in which one-side basis in which the sheet passing (conveyance) is made on the basis of one-side edge portion of the recording paper with respect to the widthwise direction.

5) The use of the image heating apparatus of the present invention is not limited to the use as the fixing device for fixing, as a fixed image, the unfixed toner image formed on the recording paper as in the above-described embodiments. The image heating apparatus of the present invention is also effective as an image glossiness adjusting device, for adjusting a surface property of an image, such that the glossiness of the image is improved by heating and pressing again the toner image (fixed toner image or temporarily fixed toner image) which is once fixed or temporarily fixed on the recording paper.

6) The type of the image forming portions of the image forming apparatus is not limited to the electrophotographic type. The image forming portions may also be of an electrostatic recording type or a magnetic recording type. Further, the type of the image forming portions is not limited to the transfer type but may also employ a constitution in which the unfixed toner image is formed on the recording paper by a direct type.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 169520/2012 filed Jul. 31, 2012 and 124633/2013 filed Jun. 13, 2013, which are hereby incorporated by reference.

What is claimed is:

1. An image heating apparatus comprising:

a rotatable heating member configured to heat a toner image formed on a recording material by using a toner containing a parting agent;

an exciting coil provided outside said rotatable heating member and configured to cause said rotatable heating member to generate heat by electromagnetic induction heating;

a magnetic flux suppressing member configured to suppress a part of magnetic flux acting from said exciting coil onto said rotatable heating member in a longitudinal direction of said rotatable heating member;

a moving mechanism configured to move said magnetic flux suppressing member between said exciting coil and said rotatable heating member depending on the width size of the recording material;

a motor configured to drive said moving mechanism; and an executing portion capable of selectively executing an operation in a first mode in which a first current is supplied to said motor and an operation in a second mode in which a second current larger than the first current is supplied to said motor.

2. An image heating apparatus according to claim 1, wherein when a main power source is turned on and then said magnetic flux suppressing member is first moved, said executing portion executes the operation in the second mode.

3. An image heating apparatus according to claim 1, wherein when a main power source is turned on and then said magnetic flux suppressing member is first reciprocated, said executing portion executes the operation in the second mode.

4. An image heating apparatus according to claim 3, when an image heating process after said magnetic flux suppressing member is first reciprocated with a return from a power saving mode is first performed, said executing portion executes the operation in the first mode.

5. An image heating apparatus according to claim 1, wherein when said image heating apparatus is returned from a power saving mode and then said magnetic flux suppressing member is first moved, said executing portion executes the operation in the second mode.

6. An image heating apparatus according to claim 1, wherein when said image heating apparatus is returned from a power saving mode and then said magnetic flux suppressing member is first reciprocated, said executing portion executes the operation in the second mode.

7. An image heating apparatus according to claim 6, wherein when an image heating process after said magnetic flux suppressing member is first reciprocated with a return from the power saving mode is first performed, said executing portion executes the operation in the first mode.

8. An image heating apparatus according to claim 1, wherein said moving mechanism includes a screw shaft to which a rotational driving force is transmitted from said motor, and includes a connecting portion configured to (i) connect said magnetic flux suppressing member with said screw shaft and (ii) move said magnetic flux suppressing member along said screw shaft with rotation of said screw shaft.

9. An image heating apparatus according to claim 1, wherein when a predetermined recording material narrower in width than a maximum width recording material usable in said image heating apparatus is subjected to image heating, said moving mechanism moves said magnetic flux suppressing member so that the magnetic flux acting on said rotatable heating member in a region where said rotatable heating member does not oppose the predetermined recording material is suppressed.

10. An image heating apparatus according to claim 1, wherein the parting agent is a wax.

11. An image heating apparatus comprising:

a rotatable heating member configured to heat a toner image formed on a recording material by using a toner containing a parting agent;

an exciting coil provided outside said rotatable heating member and configured to cause said rotatable heating member to generate heat by electromagnetic induction heating;

a magnetic flux suppressing member configured to suppress a part of magnetic flux acting from said exciting coil onto said rotatable heating member in a longitudinal direction of said rotatable heating member;

a moving mechanism configured to move said magnetic flux suppressing member between said exciting coil and said rotatable heating member depending on the width size of the recording material;

a motor configured to drive said moving mechanism; and an executing portion capable of selectively executing an operation in a first mode in which said motor is operated at a first speed and an operation in a second mode in which said motor is operated at a second speed slower than the first speed.

12. An image heating apparatus according to claim 11, wherein when a main power source is turned on and then said magnetic flux suppressing member is first moved, said executing portion executes the operation in the second mode.

13. An image heating apparatus according to claim 11, wherein when a main power source is turned on and then said magnetic flux suppressing member is first reciprocated, said executing portion executes the operation in the second mode.

14. An image heating apparatus according to claim 13, when an image heating process after said magnetic flux suppressing member is first reciprocated with a return from a power saving mode is first performed, said executing portion executes the operation in the first mode.

15. An image heating apparatus according to claim 11, wherein when said image heating apparatus is returned from a power saving mode and then said magnetic flux suppressing member is first moved, said executing portion executes the operation in the second mode.

16. An image heating apparatus according to claim 11, wherein when said image heating apparatus is returned from a power saving mode and then said magnetic flux suppressing member is first reciprocated, said executing portion executes the operation in the second mode.

17. An image heating apparatus according to claim 16, wherein when an image heating process after said magnetic flux suppressing member is first reciprocated with a return from the power saving mode is first performed, said executing portion executes the operation in the first mode.

18. An image heating apparatus according to claim 11, wherein said moving mechanism includes a screw shaft to which a rotational driving force is transmitted from said motor, and includes a connecting portion configured to (i) connect said magnetic flux suppressing member with said screw shaft and (ii) move said magnetic flux suppressing member along said screw shaft with rotation of said screw shaft.

19. An image heating apparatus according to claim 11, wherein the parting agent is a wax.

* * * * *